US009686830B2

(12) United States Patent
Sudhaus

(10) Patent No.: US 9,686,830 B2
(45) Date of Patent: Jun. 20, 2017

(54) DEVICE FOR SUPPLYING LIGHT SOURCES WITH ENERGY IN A MANNER EXTENDING SERVICE LIFE

(71) Applicant: Elmos Semiconductor AG, Dortmund (DE)

(72) Inventor: Andre Sudhaus, Dortmund (DE)

(73) Assignee: Elmos Semiconductor AG, Dortmund (DE)

( * ) Notice: Subject to any disclaimer, the term of this patent is extended or adjusted under 35 U.S.C. 154(b) by 0 days.

(21) Appl. No.: 14/908,592

(22) PCT Filed: Jul. 24, 2014

(86) PCT No.: PCT/EP2014/065943

§ 371 (c)(1),
(2) Date: Jan. 29, 2016

(87) PCT Pub. No.: WO2015/014713

PCT Pub. Date: Feb. 5, 2015

(65) Prior Publication Data

US 2016/0165678 A1 Jun. 9, 2016

(30) Foreign Application Priority Data

Jul. 29, 2013 (EP) ..... 13178386

(51) Int. Cl.
*H05B 37/00* (2006.01)
*H05B 41/00* (2006.01)
*H05B 33/08* (2006.01)

(52) U.S. Cl.
CPC ..... *H05B 33/083* (2013.01); *H05B 33/089* (2013.01); *H05B 33/0866* (2013.01); *H05B 33/0887* (2013.01)

(58) Field of Classification Search
None
See application file for complete search history.

(56) References Cited

U.S. PATENT DOCUMENTS

| | | | | |
|---|---|---|---|---|
| 8,456,095 | B2 * | 6/2013 | Huynh | H05B 33/083 315/209 R |
| 9,398,656 | B2 * | 7/2016 | Gray | H05B 33/083 |
| 2010/0194274 | A1 | 8/2010 | Hoogzaad | |
| 2011/0199003 | A1 | 8/2011 | Muguruma et al. | |
| 2011/0248640 | A1 * | 10/2011 | Welten | H05B 33/083 315/210 |
| 2011/0260617 | A1 | 10/2011 | Tanaka | |
| 2012/0153844 | A1 | 6/2012 | Chobot | |
| 2012/0223649 | A1 | 9/2012 | Saes et al. | |

FOREIGN PATENT DOCUMENTS

DE 102009025752 A1 12/2010

OTHER PUBLICATIONS

International Search Report and Written Opinion for PCT/EP2014/065943 mailed Dec. 2, 2014 (with English translation; 14 pages).

* cited by examiner

*Primary Examiner* — Anh Tran
(74) *Attorney, Agent, or Firm* — Bejin Bieneman PLC

(57) ABSTRACT

A circuit is disclosed for supplying energy to a sequential circuit of typically non-linear loads by a current source. The load is preferably a series circuit of light emitting diodes (LEDs). Said current-operated load, preferably a LED series circuit, consisting of one to N elements is partially short-circuited and thus dimmed.

19 Claims, 4 Drawing Sheets

DEVICE FOR SUPPLYING LIGHT SOURCES WITH ENERGY IN A MANNER EXTENDING SERVICE LIFE

CROSS REFERENCE TO RELATED APPLICATIONS

This application is a national stage of, and claims priority to, Patent Cooperation Treaty Application No. PCT/EP2014/065943, filed on Jul. 24, 2014, which claims priority to EP Application No. EP13178386.2 filed on Jul. 29, 2013, each of which applications are hereby incorporated herein by reference in their entireties.

BACKGROUND

The disclosure relates to a circuit to supply energy to a sequential circuit of typically nonlinear loads using a current source. Preferably, the load comprises a series circuit of LEDs. This current-driven load, preferably a series circuit of LEDs, consists of one to N elements and should be partially short-circuited or dimmed.

Various energy supply circuits for LEDs or LED series circuits are disclosed in US-A-2012/223649, DE-A-10 2009 025 752, US-A-2012/153844, and US-A-2010/194274.

Each of the nonlinear loads that is connected in series typically has one switch connected in parallel. Each of these switches may be open and/or closed.

The resulting change in voltage now presents the problem that the current is a combination of the current of the current source and the changing voltage of an energy storage that is typically present, and thus it is no longer determined directly by the current source. Such a current source can be, for example, a current-controlled DC/DC converter.

Two cases result:

a The first case, namely the case CLOSED, relates to the closing or reduction in conducting-state DC resistance of one or more of the aforementioned switches: The resulting short-term increase in current can have undesired side effects going all the way to damaging the following load.

b The second case, i.e., the case OPEN, relates to the opening or the increase in conducting-state DC resistance of one or more of the aforementioned switches: Until a supporting energy storage has been charged to an increased energy content—in the case of a capacitor to an increased voltage—it is possible that no current or insufficient current is available for the increased load. This can temporarily limit the function. For example, the luminous intensity of an LED chain can noticeably decrease. However, as a rule if transients are short they are not perceived as loads by LEDs. But if the loads are motor phases or relays, an interruption in the current such as described could have undesired side effects.

SUMMARY

It is the goal of the disclosure to provide, at any time, a constant, possibly maximum energy, without limits being exceeded, especially by transients, and without there being substantial changes of the energy conversions in the actuators.

The device should simultaneously be able to recognize defective consumers.

This is accomplished with the device and the process as described below.

The disclosure advantageously proposes a process to check a device for supplying energy to a circuit having at least one first consumer and at least one current source, wherein at least one first load is driven in a device
- that has at least one detection device that is able to capture
  - a) the current value; and/or
  - b) the rate of change in the current; and/or
  - c) a higher time derivative of the current value through at least a first consumer or a sequential circuit of multiple first consumers or a subnet of first consumers, in particular using measurement techniques; and
- the device has at least one controller that opens or closes at least one of the switches, or changes its conducting-state DC resistance, on the basis of at least one of the previously determined values, wherein
- the aforementioned controller simultaneously checks whether the time change
  - a) of the current value; and/or
  - b) of the rate of change in the current; and/or
  - c) of a higher time derivative of the current value
- through the aforementioned first consumer or through a sequential circuit of multiple first consumers or a subnet follows, within a specified tolerance band, a specified setpoint function as a function of the timing of the OPENING or CLOSING or the change in the conducting-state DC resistance; and
- derives from this a measured value for the state of the consumer and/or changes the control function of the controller on the basis of the deviation from such a setpoint function, wherein the measurement can also be binary, and/or at least one energy storage is driven in the device described in one or more of the preceding claims;
- that has at least one measuring device that is able to measure
  - a) the remaining energy content of at least the energy storage; and/or
  - b) the rate of change in the energy content of at least of the energy storage; and/or
  - c) a higher time derivative of the energy content of at least the aforementioned energy storage;

and
- the device has at least one controller that opens or closes at least one of the switches, or changes its conducting-state DC resistance, on the basis of at least one of the previously determined values, wherein
- the aforementioned controller simultaneously checks whether the time change
  - a) of the remaining energy content of at least the energy storage; and/or
  - b) of the rate of change in the energy content of at least the energy storage; and/or
  - c) of a higher time derivative of the energy content of at least the aforementioned energy storage
- agrees, within a specified tolerance band, a specified function depending on the timing of the OPENING or CLOSING or the change of the conducting-state DC resistance, wherein the energy content can also be determined in the form of a significant variable; and/or
- derives from this a measured value for the state of the consumer and/or changes the control function of the controller on the basis of the deviation of such a setpoint function.

Here it can be expedient, if at least one state value of the device is transferred through an interface, wherein this state value can be one of the following state values or their single or higher derivative:

a) a control value of one of the outputs of the controller;
b) an internal control value of the controller;
c) a measured value or state value of one of the sensors;
d) the current value of one of the current measurement points;
e) the voltage value at one of the nodes;
f) the difference between the control value and the measured value at the controller;
g) the state of one or more of the switching elements involved;
h) a measured value corresponding to the voltage across at least one of the switching elements
i) a measured value corresponding to the current in at least one of the switching elements.

In the context of this disclosure, the term "current source" generally means a source for the delivery of electrical energy. This means that a switching regulator is also a possible alternative, in addition to current source in the narrower sense. It is decisive that providing electrical current and/or electrical voltage can put electrical energy in the output nodes.

This disclosure includes at least:

a) Measuring the current through the LED chain and the energy content of the capacitor (energy storage), and their time derivatives to control the power transistors;
b) Measuring the time derivatives of the current through the LED chain or measuring the energy content of the capacitor (energy storage) and its time derivatives for control of the power transistors;
c) Measuring the current through the LED chain and/or the energy content of the capacitor (energy storage) and their time derivatives to control the power transistors and change the duty cycles, if the current through the LED chain or its time derivatives exceed a maximum value, or analogously if it (they) fall(s) below a minimum value.
d) Measuring the current through the LED chain and/or the energy content of the capacitor (energy storage) and their time derivatives to control the power transistors and change the duty cycles, if the energy content of the energy storage (capacitor) or its time derivatives exceed a maximum value, or analogously if it (they) fall(s) below a minimum value.
e) Measuring the current through the LED chain and/or the energy content of the capacitor (energy storage) and their time derivatives to control the power transistors and simultaneously not closing any switch if the current or one of its derivatives exceed a maximum value, and/or not opening any switch if the current or one of its derivatives lies below a minimum value.
f) Measuring the current through the LED chain and the energy content of the capacitor (energy storage), and their time derivatives to control the power transistors, and not closing or opening any switch simultaneously with another.
g) Measuring the energy content of the capacitor (energy storage), and their time derivatives to control the power transistors.

Individual aspects/variants of the disclosure are listed below.

1. A device including at least one first consumer, at least one current source, and an energy supply unit to supply energy to the at least one first consumer (4), wherein the energy supply unit is provided with at least one energy storage (2), wherein energy can be fed into a first output node (7) by the at least one current source (1) and the at least one energy storage (2);

wherein the at least one first consumer (4) can at least temporarily be supplied with energy through this output node (7);

wherein the energy storage (2) is designed to supply energy when the energy delivery of the current source (1) is insufficient and the energy storage (2) still has sufficient energy content;

at least one switch (3) connected in parallel with at least one first consumer (4) to bypass and/or cancel a bypass of the first consumer (4) associated with the switch (3); and at least one current and/or current change detection device (5) and/or an energy and/or energy change detection device;

wherein the current and/or current change detection device (5) is designed to determine a) the current value; and/or
b) the rate of change in the current; and/or
c) a higher time derivative of the current value through the aforementioned first consumer or a sequential circuit of multiple first consumers in particular using measurement techniques; and wherein the energy and/or energy change detection device (14) is designed to determine a) the remaining energy content in the at least one energy storage (2); and/or
b) the rate of change of the energy content in the at least one energy storage (2); and/or
c) a higher time derivative of the energy content in the at least one energy storage (2)

in particular using measurement techniques, wherein the energy content can also be determined by determining a variable representing it; and at least one controller (6) that opens or closes at least one of the switches (3), or changes its conducting-state DC resistance, on the basis of at least one of the previously determined values.

1.1. The device described in number 1, wherein it has more than one first consumer (4) and these first consumers (4) are connected in series; and the first consumers (4) can be supplied by at least a partial current of the current source (1).

1.2. The device described in number 1 or 1.1, wherein the energy supply unit is designed not to close any switch or to reduce its conducting-state DC resistance a) if the measured current value lies above a specified value $I_{max1}$ and/or
b) if the amount of the measured rate of change in the current lies above a specified value $I_{max_sp1}$, and/or
c) if the amount of the measured higher time derivative of the current value lies above a specified value $I_{max_ac1}$ and/or not to open any switch or to increase its conducting-state DC resistance a) if the measured current value lies below a specified value $I_{min1}$ and/or b) if the amount of the measured rate of change in the current lies below a specified value $I_{min_sp1}$ and/or c) if the amount of the measured higher time derivative of the current value lies below a specified value $I_{min_ac1}$.

1.3. The device described in one or more of the numbers 1 through 1.2, wherein the energy supply unit is designed to reduce, at least temporarily, the mean duration of the closing or the reduction in the conducting-state DC resistance of a switch relative to a time period if the measured current value lies above a specified value $I_{max2}$ and/or to reduce, at least temporarily, the mean duration of the closing or reduction in the conducting-state DC resistance of a switch relative to a time period, if the amount of the measured rate of change in the current lies above a specified value $I_{max_sp2}$ and/or to reduce, at least temporarily, the mean duration of the closing or reduction in the conducting-state DC resistance of a switch relative to a time period, if the amount of the measured higher time derivative of the current value lies above a specified value $I_{max_ac2}$ and/or to increase, at least temporarily, the mean duration of the closing or reduction in the conducting-state DC resistance of a switch relative to a time period if the measured current value lies below a specified value $I_{min2}$ and/or to increase, at least temporarily, the mean duration of the closing or reduction in the conducting-state DC resistance of a switch relative to a time period, if the amount of the measured rate of change in the current lies below a specified value $I_{min_sp2}$ and/or to increase, at least temporarily, the mean duration of the closing or reduction in the conducting-state DC resistance of a switch relative to a time period, if the amount of the measured higher time derivative of the current value lies below a specified value $I_{min_ac2}$.

1.4. The device described in one or more of the preceding numbers, wherein the energy supply unit is designed to lower, at least temporarily, the mean duration of the closing or reduction in the conducting-state DC resistance of a switch relative to a time period if the measured energy content of the energy storage 2 lies below a specified value $U_{es_min2}$; and/or to lower, at least temporarily, the mean duration of the closing or reduction in the conducting-state DC resistance of a switch relative to a time period, if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period, if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period if the measured energy content of the energy storage 2 lies above a specified value $U_{es_min3}$; and/or to increase, at least temporarily, the mean duration of the closing or reduction in the conducting-state DC resistance of a switch relative to a time period, if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

1.5. The device described in one or more of the preceding numbers, wherein the at least one switch is a power transistor.

1.6. The device described in number 1.5, wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

1.7. The device described in number 1.5 or 1.6, wherein the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

1.8. The device described in one or more of the preceding numbers, wherein the energy supply unit is designed to close or reduce the conducting-state DC resistance of at least one first switch simultaneously with the opening or increasing of the conducting-state DC resistance of at least one second switch in order to keep the following within specified or programmed range:

a) the current value captured by a sensing element; and/or b) the rate of change in the current captured by a sensing element; and/or c) a higher time derivative of the rate of change in the current captured by a sensing element.

1.9. The device described in one or more of the preceding numbers, wherein the energy supply unit is designed not to turn on or off any second switch or change its conducting-state DC resistance during the turning on and/or off or changing the conducting-state DC resistance of at least of one first switch; and/or so that the time interval between the turning on and/or off of at least one first switch or changing of its conducting-state DC resistance and the turning on and/or off of at least one second switch or changing of its conducting-state DC resistance does not to fall below a minimum value $t_{min_s}$.

1.10. The device described in one or more of the preceding numbers comprising a device to supply a circuit of at least three consumers (4)

wherein these at least three consumers are connected in at least two parallel series circuits, wherein at least one of these at least two series circuits is a series circuit of at least two consumers (4); and the other series circuit of the at least two series circuits can be a single third consumer (4) or a series circuit of two or more consumers (4), wherein energy can be fed into a first output node (7) by at least one current source (1) and an energy storage (2), wherein the at least three consumers (4) can at least temporarily be supplied with energy through this output node (7), and wherein at least one of the aforementioned at least three consumers (4) has least one switch (3) connected in parallel with it to bypass and/or cancel a bypass of the consumer (4) in question.

1.11. The device described in number 1.10 comprising at least one device (5) that determines a) the current value and/or b) the rate of change in the current and/or c) a higher time derivative of the current value through the sequential circuit of the aforementioned consumers (4) of at least one or more or all of the aforementioned at least two series circuits, in particular using measurement techniques.

1.12. The device described in one or more of the preceding numbers, wherein it has at least two consumers;

and at least one switch associated with each of them, that is a total of at least two such switches;

the controller (6) is designed to control the common energy consumption of at least these two consumers so that it corresponds, linearly or nonlinearly, with a value specified by the controller (6) or from outside the system; and the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

1.13. The device described in number 1.12, wherein the consumers are lamps or light-emitting diodes in one or more luminous colors.

1.14. The device described in one of the preceding numbers, wherein the energy supply unit is designed to make the energy conversion dependent, both in its amount and/or in its apportionment to the consumers, on one or more of the following parameters:

a) a value that is received through an interface or programmed; and/or b) the measured value of one or more color sensors; and/or c) the measured value of a temperature sensor; and/or d) the measured value of another sensor that measures an effect of at least one of the consumers.

2. A device including at least one first consumer, at least one current source, and an energy supply unit to supply energy to the at least one first consumer (4), wherein the energy supply unit is provided with at least one energy storage (2), wherein energy can be fed into a first output node (7) by the at least one current source (1) and the at least one energy storage (2), wherein the at least one first consumer (4) can at least temporarily be supplied with energy through this output node (7), wherein the energy storage (2) is designed to supply energy when the energy delivery of the current source (1) is insufficient and the energy storage (2) still has sufficient energy content;

at least one switch (3) connected in parallel with at least one first consumer (4) to bypass and/or cancel a bypass of the first consumer (4) associated with the switch (3); and at least one energy and/or energy change detection device, wherein the energy and/or energy change detection device (14) is designed to determine a) the remaining energy content in the at least one energy storage (2); and/or b) the rate of change of the energy content in the at least one energy storage (2); and/or c) a higher time derivative of the energy content in the at least one energy storage (2)

in particular using measurement techniques, wherein the energy content can also be determined by determining a variable representing it; and at least one controller (6) that opens or closes at least one of the switches (3), or changes its conducting-state DC resistance, on the basis of at least one of the previously determined values.

2.1. The device described in number 2, wherein the current and/or current change detection device (5) is designed to determine a) the current value; and/or b) the rate of change in the current; and/or c) a higher time derivative of the current value through the aforementioned first consumer (4) or a sequential circuit of multiple first consumers (4), in particular using measurement techniques.

2.2. The device described in number 2 or 2.1, wherein it has more than one first consumer (4) and these first consumers (4) are connected in series; and the first consumers (4) can be supplied by at least a partial current of the current source (1).

2.3. The device described in number 2.1 or 2.2, wherein the energy supply unit is designed not to close any switch or to reduce its conducting-state DC resistance a) if the measured current value lies above a specified value $I_{max1}$; and/or b) if the amount of the measured rate of change in the current lies above a specified value $I_{max_sp1}$; and/or c) if the amount of the measured higher time derivative of the current value lies above a specified value $I_{max_ac1}$; and/or not to open any switch or to increase its conducting-state DC resistance, a) if the measured current value lies below a specified value $I_{min1}$; and/or b) if the amount of the measured rate of change in the current lies below a specified value $I_{min_sp1}$; and/or c) if the amount of the measured higher time derivative of the current value lies below a specified value $I_{min_ac1}$.

2.4. The device described in one or more of the numbers 2 through 2.3, wherein the energy supply unit is designed to reduce, at least temporarily, the mean duration of the closing or the reduction in the conducting-state DC resistance of a switch relative to a time period if the measured current value lies above a specified value $I_{max2}$; and/or to reduce, at least temporarily, the mean duration of the closing or reduction in the conducting-state DC resistance of a switch relative to a time period, if the amount of the measured rate of change in the current lies above a specified value $I_{max_sp2}$; and/or to reduce, at least temporarily, the mean duration of the closing or reduction in the conducting-state DC resistance of a switch relative to a time period, if the amount of the measured higher time derivative of the current value lies above a specified value $I_{max_ac2}$; and/or to increase, at least temporarily, the mean duration of the closing or reduction in the conducting-state DC resistance of a switch relative to a time period if the measured current value lies below a specified value $I_{min2}$ and/or to increase, at least temporarily, the mean duration of the closing or reduction in the conducting-state DC resistance of a switch relative to a time period, if the amount of the measured rate of change in the current lies below a specified value $I_{min_sp2}$; and/or to increase, at least temporarily, the mean duration of the closing or reduction in the conducting-state DC resistance of a switch relative to a time period, if the amount of the measured higher time derivative of the current value lies below a specified value $I_{min_ac2}$.

2.5. The device described in one or more of the preceding numbers, wherein the energy supply unit is designed to lower, at least temporarily, the mean duration of the closing or reduction in the conducting-state DC resistance of a switch relative to a time period if the measured energy content of the energy storage 2 lies below a specified value $U_{es_min2}$; and/or to lower, at least temporarily, the mean duration of the closing or reduction in the conducting-state DC resistance of a switch relative to a time period, if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period, if the measured energy content of the energy storage 2 lies above a specified value $U_{es_min3}$; and/or to increase, at least temporarily, the mean duration of the closing or reduction in the conducting-state DC resistance of a switch relative to a time period if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

2.6. The device described in one or more of the preceding numbers, wherein the at least one switch is a power transistor.

2.7. The device described in number 2.6 wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

2.8. The device described in number 2.6 or 2.7, wherein the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

2.9. The device described in one or more of the preceding numbers, wherein the energy supply unit is designed to close or reduce the conducting-state DC resistance of at least one first switch simultaneously with the opening or increasing of the conducting-state DC resistance of at least one second switch in order to keep the following within specified or programmed range:

a) the current value captured by a sensing element; and/or b) the rate of change in the current captured by a sensing element; and/or c) a higher time derivative of the rate of change in the current captured by a sensing element.

2.10. The device described in one or more of the preceding numbers, wherein the energy supply unit is designed not to turn on or off any second switch or change its conducting-state DC resistance during the turning on and/or off or changing the conducting-state DC resistance of at least of one first switch; and/or so that the time interval between the turning on or off of at least one first switch or changing of its conducting-state DC resistance and the turning on or off of at least one second switch or changing of its conducting-state DC resistance does not to fall below a minimum value train s.

2.11. The device described in one or more of the preceding numbers comprising a device to supply a circuit of at least three consumers (4)

wherein these at least three consumers are connected in at least two parallel series circuits, wherein at least one of these at least two series circuits is a series circuit of at least two consumers (4); and the other series circuit of the at least two series circuits can be a single third consumer (4) or a series circuit of two or more consumers (4), wherein energy can be fed into a first output node (7) by at least one current source (1) and an energy storage (2), wherein the at least three consumers (4) can at least temporarily be supplied with energy through this output node (7), and wherein at least one of the aforementioned at least three consumers (4) has least one switch (3) connected in parallel with it to bypass and/or cancel a bypass of the consumer (4) in question.

2.12. The device described in number 2.11 comprising at least one device (5) that determines a) the current value; and/or b) the rate of change in the current; and/or c) a higher time derivative of the current value through the sequential circuit of the aforementioned consumers (4) of at least one or more or all of the aforementioned at least two series circuits, in particular using measurement techniques.

2.13. The device described in one or more of the preceding numbers, wherein it has at least two consumers;

and at least one switch associated with each of them, that is a total of at least two such switches;

the controller (6) is designed to control the common energy consumption of at least these two consumers so that it corresponds, linearly or nonlinearly, with a value specified by the controller (6) or from outside of the system; and the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

2.14. The device described in number 2.13, wherein the consumers are lamps or light-emitting diodes in one or more luminous colors.

2.15. The device described in one of the preceding numbers, wherein the energy supply unit is designed to make the energy conversion dependent, both in its amount and/or in its apportionment to the consumers, on one or more of the following parameters:

a) a value that is received through an interface or programmed; and/or
b) the measured value of one or more color sensors; and/or
c) the measured value of a temperature sensor; and/or
d) the measured value of another sensor that measures an effect of at least one of the consumers.

3. A device including
at least one first consumer, at least one current source, and an energy supply unit to supply energy to the at least one first consumer (4), wherein the energy supply unit is provided with
at least one energy storage (2),
wherein energy can be fed into a first output node (7) by the at least one current source (1) and the at least one energy storage (2),
wherein the at least one first consumer (4) can at least temporarily be supplied with energy through this output node (7),
wherein the energy storage (2) is designed to supply energy when the energy delivery of the current source (1) is insufficient and the energy storage (2) still has sufficient energy content,
at least one switch (3) connected in parallel with at least one first consumer (4) to bypass and/or cancel a bypass of the first consumer (4) associated with the switch (3); and
at least one current change detection device (5),
wherein the current and/or current change detection device (5) is designed to determine
a) the rate of change in the current; and/or
b) a higher time derivative of the current value through the aforementioned first consumer (4) or a sequential circuit of multiple first consumers (4),
in particular using measurement techniques; and
at least one controller (6) that opens or closes at least one of the switches (3), or changes its conducting-state DC resistance, on the basis of at least one of the previously determined values.

3.1 The device described in number 3, wherein at least one current detection device (5) and/or an energy and/or energy change detection device is designed to determine
a) the remaining energy content in the at least one energy storage (2); and/or
b) the rate of change of the energy content in the at least one energy storage (2); and/or
c) a higher time derivative of the energy content in the at least one energy storage; (2)
in particular using measurement techniques, wherein the energy content can also be determined by determining a variable representing it.

3.2 The device described in number 3 or 3.1, wherein
it has more than one first consumer (4) and these first consumers (4) are connected in series; and
the first consumers (4) can be supplied by at least a partial current of the current source (1).

3.3. The device described in number 3.1 or 3.2, wherein the energy supply unit is designed
not to close any switch or to reduce its conducting-state DC resistance
a) if the measured current value lies above a specified value $I_{max1}$; and/or
b) if the amount of the measured rate of change in the current lies above a specified value $I_{max_sp1}$; and/or
c) if the amount of the measured higher time derivative of the current value lies above a specified value $I_{max_ac1}$; and/or
not to open any switch or to increase its conducting-state DC resistance
a) if the measured current value lies below a specified value $I_{min1}$; and/or
b) if the amount of the measured rate of change in the current lies below a specified value $I_{min_sp1}$; and/or
c) if the amount of the measured higher time derivative of the current value lies below a specified value $I_{min_ac1}$.

3.4. The device described in one or more of the numbers 3 through 3.3, wherein the energy supply unit is designed
to reduce, at least temporarily, the mean duration of the closing or the reduction in the conducting-state DC resistance of a switch relative to a time period if the measured current value lies above a specified value $I_{max2}$; and/or
to reduce, at least temporarily, the mean duration of the closing or reduction in the conducting-state DC resistance of a switch relative to a time period if the amount of the measured rate of change in the current lies above a specified value $I_{max_sp2}$; and/or
to reduce, at least temporarily, the mean duration of the closing or reduction in the conducting-state DC resistance of a switch relative to a time period if the amount of the measured higher time derivative of the current value lies above a specified value $I_{max_ac2}$; and/or
to increase, at least temporarily, the mean duration of the closing or reduction in the conducting-state DC resistance of a switch relative to a time period if the measured current value lies below a specified value $I_{min2}$; and/or
to increase, at least temporarily, the mean duration of the closing or reduction in the conducting-state DC resistance of a switch relative to a time period if the amount of the measured rate of change in the current lies below a specified value $I_{min_sp2}$; and/or
to increase, at least temporarily, the mean duration of the closing or reduction in the conducting-state DC resistance of a switch relative to a time period, if the amount of the measured higher time derivative of the current value lies below a specified value $I_{min_ac2}$.

3.5. The device described in one or more of the preceding numbers, wherein the energy supply unit is designed
to lower, at least temporarily, the mean duration of the closing or reduction in the conducting-state DC resistance of a switch relative to a time period if the measured energy content of the energy storage 2 lies below a specified value $U_{es_min2}$; and/or
to lower, at least temporarily, the mean duration of the closing or reduction in the conducting-state DC resistance of a switch relative to a time period if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period if the measured energy content of the energy storage 2 lies above a specified value $U_{es_min3}$; and/or to increase, at least temporarily, the mean duration of the closing or reduction in the conducting-state DC resistance of a switch relative to a time period if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

3.6. The device described in one or more of the preceding numbers, wherein the at least one switch is a power transistor.

3.7. The device described in number 3.6, wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

3.8. The device described in number 3.6 or 3.7, wherein the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

3.9. The device described in one or more of the preceding numbers, wherein the energy supply unit is designed to close or reduce the conducting-state DC resistance of at least one first switch simultaneously with the opening or increasing of the conducting-state DC resistance of at least one second switch in order to keep the following within specified or programmed range:

a) the current value captured by a sensing element; and/or b) the rate of change in the current captured by a sensing element; and/or c) a higher time derivative of the rate of change in the current captured by a sensing element.

3.10. The device described in one or more of the preceding numbers, wherein the energy supply unit is designed not to turn on or off any second switch or change its conducting-state DC resistance during the turning on and/or off or changing the conducting-state DC resistance of at least of one first switch; and/or so that the time interval between the turning on and/or off of at least one first switch or changing of its conducting-state DC resistance and the turning on and/or off of at least one second switch or changing of its conducting-state DC resistance does not to fall below a minimum value $t_{min_s}$.

3.11. The device described in one or more of the preceding numbers comprising a device to supply a circuit of at least three consumers (4)

wherein these at least three consumers are connected in at least two parallel series circuits, wherein at least one of these at least two series circuits is a series circuit of at least two consumers (4); and the other series circuit of the at least two series circuits can be a single third consumer (4) or a series circuit of two or more consumers (4), wherein energy can be fed into a first output node (7) by at least one current source (1) and an energy storage (2), wherein the at least three consumers (4) can at least temporarily be supplied with energy through this output node (7), and wherein at least one of the aforementioned at least three consumers (4) has least one switch (3) connected in parallel with it to bypass and/or cancel a bypass of the consumer (4) in question.

3.12. The device described in number 3.11 comprising at least one device (5) that determines a) the current value; and/or b) the rate of change in the current; and/or c) a higher time derivative of the current value through the sequential circuit of the aforementioned consumers (4) of at least one or more or all of the aforementioned at least two series circuits, in particular using measurement techniques.

3.13. The device described in one or more of the preceding numbers, wherein it has at least two consumers;

and at least one switch associated with each of them, that is a total of at least two such switches;

the controller (6) is designed to control the common energy consumption of at least these two consumers so that it corresponds, linearly or nonlinearly, with a value specified by the controller (6) or from outside the system; and the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

3.14. The device described in number 3.13, wherein the consumers are lamps or light-emitting diodes in one or more luminous colors.

3.15. The device described in one of the preceding numbers, wherein the energy supply unit is designed to make the energy conversion dependent, both in its amount and/or in its apportionment to the consumers, on one or more of the following parameters:

a) a value that is received through an interface or programmed; and/or b) the measured value of one or more color sensors; and/or c) the measured value of a temperature sensor; and/or d) the measured value of another sensor that measures an effect of at least one of the consumers.

4. A device including at least one first consumer, at least one current source, and an energy supply unit to supply energy to the at least one first consumer (4), wherein the energy supply unit is provided with at least one energy storage (2), wherein energy can be fed into a first output node (7) by the at least one current source (1) and the at least one energy storage (2), wherein the at least one first consumer (4) can at least temporarily be supplied with energy through this output node (7), wherein the energy storage (2) is designed to supply energy when the energy delivery of the current source (1) is insufficient and the energy storage (2) still has sufficient energy content, at least one switch (3) connected in parallel with at least one first consumer (4) to bypass and/or cancel a bypass of the first consumer (4) associated with the switch (3); and at least one current and/or current change detection device (5) and/or an energy and/or energy change detection device, wherein the current and/or current change detection device (5) is designed to determine a) the current value; and/or b) the rate of change in the current; and/or c) a higher time derivative of the current value through the aforementioned first consumer (4) or a sequential circuit of multiple first consumers (4), in particular using measurement techniques; and wherein the energy and/or energy change detection device (14) is designed to determine a) the remaining energy content in the at least one energy storage (2); and/or b) the rate of change of the energy content in the at least one energy storage (2); and/or c) a higher time derivative of the energy content in the at least one energy storage (2)

in particular using measurement techniques, wherein the energy content can also be determined by determining a variable representing it; and at least one controller (6) that opens or closes at least one of the switches (3), or changes its conducting-state DC resistance, on the basis of at least one of the previously determined values, wherein the energy supply unit is designed not to close any switch or to reduce its conducting-state DC resistance a) if the measured current value lies above a specified value $I_{max1}$; and/or b) if the amount of the measured rate of change in the current lies above a specified value $I_{max_sp1}$; and/or c) if the amount of the measured higher time derivative of the current value lies above a specified value $I_{max_ac1}$; and/or not to open any switch or to increase its conducting-state DC resistance a) if the measured current value lies below a specified value $I_{min1}$; and/or b) if the amount of the measured rate of change in the current lies below a specified value $I_{min_sp1}$; and/or c) if the amount of the measured higher time derivative of the current value lies below a specified value $I_{min_ac1}$.

4.1. The device described in number 4 wherein it has more than one first consumer (4) and these first consumers (4) are connected in series; and the first consumers (4) can be supplied by at least a partial current of the current source (1).

4.2. The device described in number 4 or 4.1, wherein the energy supply unit is designed to reduce, at least temporarily, the mean duration of the closing or the reduction in the conducting-state DC resistance of a switch relative to a time period if the measured current value lies above a specified value $I_{max2}$; and/or to reduce, at least temporarily, the mean duration of the closing or reduction in the conducting-state DC resistance of a switch relative to a time period if the amount of the measured rate of change in the current lies above a specified value $I_{max_sp2}$; and/or to reduce, at least temporarily, the mean duration of the closing or reduction in the conducting-state DC resistance of a switch relative to a time period if the amount of the measured higher time derivative of the current value lies above a specified value $I_{max_ac2}$; and/or to increase, at least temporarily, the mean duration of the closing or reduction in the conducting-state DC resistance of a switch relative to a time period if the measured current value lies below a specified value $I_{min2}$; and/or to increase, at least temporarily, the mean duration of the closing or reduction in the conducting-state DC resistance of a switch relative to a time period if the amount of the measured rate of change in the current lies below a specified value $I_{min_sp2}$; and/or to increase, at least temporarily, the mean duration of the closing or reduction in the conducting-state DC resistance of a switch relative to a time period, if the amount of the measured higher time derivative of the current value lies below a specified value $I_{min_ac2}$.

4.3. The device described in one or more of the preceding numbers, wherein the energy supply unit is designed to lower, at least temporarily, the mean duration of the closing or reduction in the conducting-state DC resistance of a switch relative to a time period if the measured energy content of the energy storage 2 lies below a specified value $U_{es_min2}$; and/or to lower, at least temporarily, the mean duration of the closing or reduction in the conducting-state DC resistance of a switch relative to a time period if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period if the measured energy content of the energy storage 2 lies above a specified value $U_{es_min3}$; and/or to increase, at least temporarily, the mean duration of the closing or reduction in the conducting-state DC resistance of a switch relative to a time period if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

4.4. The device described in one or more of the preceding numbers, wherein the at least one switch is a power transistor.

4.5. The device described in number 4.4 wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

4.6. The device described in number 4.4 or 4.5, wherein the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

4.7. The device described in one or more of the preceding numbers, wherein the energy supply unit is designed to close or reduce the conducting-state DC resistance of at least one first switch simultaneously with the opening or increasing of the conducting-state DC resistance of at least one second switch in order to keep the following within specified or programmed range:

a) the current value captured by a sensing element; and/or b) the rate of change in the current captured by a sensing element; and/or c) a higher time derivative of the rate of change in the current captured by a sensing element.

4.8. The device described in one or more of the preceding numbers, wherein the energy supply unit is designed not to turn on or off any second switch or change its conducting-state DC resistance during the turning on and/or off or changing the conducting-state DC resistance of at least of one first switch; and/or so that the time interval between the turning on and/or off of at least one first switch or changing of its conducting-state DC resistance and the turning on and/or off of at least one second switch or changing of its conducting-state DC resistance does not to fall below a minimum value $t_{min_s}$.

4.9. The device described in one or more of the preceding numbers comprising a device to supply a circuit of at least three consumers (4)

wherein these at least three consumers are connected in at least two parallel series circuits, wherein at least one of these at least two series circuits is a series circuit of at least two consumers (4); and the other series circuit of the at least two series circuits can be a single third consumer (4) or a series circuit of two or more consumers (4), wherein energy can be fed into a first output node (7) by at least one current source (1) and an energy storage (2), wherein the at least three consumers (4) can at least temporarily be supplied with energy through this output node (7), and wherein at least one of the aforementioned at least three consumers (4) has least one switch (3) connected in parallel with it to bypass and/or cancel a bypass of the consumer (4) in question.

4.10. The device described in number 4.9 comprising at least one device (5) that determines a) the current value; and/or b) the rate of change in the current; and/or c) a higher time derivative of the current value through the sequential circuit of the aforementioned consumers (4) of at least one or more or all of the aforementioned at least two series circuits, in particular using measurement techniques.

4.11. The device described in one or more of the preceding numbers, wherein it has at least two consumers;

and at least one switch associated with each of them, that is a total of at least two such switches;

the controller (6) is designed to control the common energy consumption of at least these two consumers so that it corresponds, linearly or nonlinearly, with a value specified by the controller (6) or from outside the system; and the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

4.12. The device described in number 4.11, wherein the consumers are lamps or light-emitting diodes in one or more luminous colors.

4.13. The device described in one of the preceding numbers, wherein the energy supply unit is designed to make the energy conversion dependent, both in its amount and/or in its apportionment to the consumers, on one or more of the following parameters:

a) a value that is received through an interface or programmed; and/or b) the measured value of one or more color sensors; and/or c) the measured value of a temperature sensor; and/or d) the measured value of another sensor that measures an effect of at least one of the consumers.

5. A device including at least one first consumer, at least one current source, and an energy supply unit to supply energy to the at least one first consumer (4), wherein the energy supply unit is provided with at least one energy storage (2), wherein energy can be fed into a first output node (7) by the at least one current source (1) and the at least one energy storage (2), wherein the at least one first consumer (4) can at least temporarily be supplied with energy through this output node (7), wherein the energy storage (2) is designed to supply energy when the energy delivery of the current source (1) is insufficient and the energy storage (2) still has sufficient energy content, at least one switch (3) connected in parallel with at least one first consumer (4) to bypass and/or cancel a bypass of the first consumer (4) associated with the switch (3); and at least one current and/or current change detection device (5) and/or an energy and/or energy change detection device, wherein the current and/or current change detection device (5) is designed to determine a) the current value; and/or b) the rate of change in the current; and/or c) a higher time derivative of the current value through the aforementioned first consumer (4) or a sequential circuit of multiple first consumers (4), in particular using measurement techniques; and wherein the energy and/or energy change detection device (14) is designed to determine a) the remaining energy content in the at least one energy storage (2); and/or b) the rate of change of the energy content in the at least one energy storage (2); and/or c) a higher time derivative of the energy content in the at least one energy storage (2)

in particular using measurement techniques, wherein the energy content can also be determined by determining a variable representing it; and at least one controller (6) that opens or closes at least one of the switches (3), or changes its conducting-state DC resistance, on the basis of at least one of the previously determined values, wherein the energy supply unit is designed to reduce, at least temporarily, the mean duration of the closing or the reduction in the conducting-state DC resistance of a switch relative to a time period if the measured current value lies above a specified value $I_{max2}$; and/or to reduce, at least temporarily, the mean duration of the closing or reduction in the conducting-state DC resistance of a switch relative to a time period if the amount of the measured rate of change in the current lies above a specified value $I_{max_sp2}$; and/or to reduce, at least temporarily, the mean duration of the closing or reduction in the conducting-state DC resistance of a switch relative to a time period if the amount of the measured higher time derivative of the current value lies above a specified value $I_{max_ac2}$; and/or to increase, at least temporarily, the mean duration of the closing or reduction in the conducting-state DC resistance of a switch relative to a time period if the measured current value lies below a specified value $I_{min2}$; and/or to increase, at least temporarily, the mean duration of the closing or reduction in the conducting-state DC resistance of a switch relative to a time period if the amount of the measured rate of change in the current lies below a specified value $I_{min_sp2}$; and/or to increase, at least temporarily, the mean duration of the closing or reduction in the conducting-state DC resistance of a switch relative to a time period, if the amount of the measured higher time derivative of the current value lies below a specified value $I_{min_ac2}$.

and/or wherein the energy supply unit is designed to lower, at least temporarily, the mean duration of the closing or reduction in the conducting-state DC resistance of a switch relative to a time period if the measured energy content of the energy storage 2 lies below a specified value $U_{es_min2}$; and/or to lower, at least temporarily, the mean duration of the closing or reduction in the conducting-state DC resistance of a switch relative to a time period if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period if the measured energy content of the energy storage 2 lies above a specified value $U_{es_min3}$; and/or to increase, at least temporarily, the mean duration of the closing or reduction in the conducting-state DC resistance of a switch relative to a time period if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

5.1. The device described in number 5 wherein it has more than one first consumer (4) and these first consumers (4) are connected in series; and the first consumers (4) can be supplied by at least a partial current of the current source (1).

5.2. The device described in number 5 or 5.1, wherein the energy supply unit is designed not to close any switch or to reduce its conducting-state DC resistance a) if the measured current value lies above a specified value $I_{max1}$; and/or b) if the amount of the measured rate of change in the current lies above a specified value $I_{max_sp1}$; and/or c) if the amount of the measured higher time derivative of the current value lies above a specified value $I_{max_ac1}$; and/or not to open any switch or to increase its conducting-state DC resistance, a) if the measured current value lies below a specified value $I_{min1}$; and/or b) if the amount of the measured rate of change in the current lies below a specified value $I_{min_sp1}$; and/or c) if the amount of the measured higher time derivative of the current value lies below a specified value $I_{min_ac1}$.

5.3. The device described in one or more of the preceding numbers, wherein the at least one switch is a power transistor.

5.4. The device described in number 5.3 wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

5.5. The device described in number 5.3 or 5.4, wherein
the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

5.6. The device described in one or more of the preceding numbers, wherein the energy supply unit is designed
to close or reduce the conducting-state DC resistance of at least one first switch simultaneously with the opening or increasing of the conducting-state DC resistance of at least one second switch in order to keep the following within specified or programmed range:
a) the current value captured by a sensing element; and/or
b) the rate of change in the current captured by a sensing element; and/or
c) a higher time derivative of the rate of change in the current captured by a sensing element.

5.7. The device described in one or more of the preceding numbers, wherein the energy supply unit is designed
not to turn on or off any second switch or change its conducting-state DC resistance during the turning on and/or off or changing the conducting-state DC resistance of at least of one first switch; and/or
so that the time interval between the turning on and/or off of at least one first switch or changing of its conducting-state DC resistance and the turning on and/or off of at least one second switch or changing of its conducting-state DC resistance does not to fall below a minimum value $t_{min_s}$.

5.8. The device described in one or more of the preceding numbers comprising
a device to supply a circuit of at least three consumers (4)
wherein these at least three consumers are connected in at least two parallel series circuits, wherein
at least one of these at least two series circuits is a series circuit of at least two consumers (4); and
the other series circuit of the at least two series circuits can be a single third consumer (4) or a series circuit of two or more consumers (4),
wherein energy can be fed into a first output node (7) by at least one current source (1) and an energy storage (2),
wherein the at least three consumers (4) can at least temporarily be supplied with energy through this output node (7), and
wherein at least one of the aforementioned at least three consumers (4) has least one switch (3) connected in parallel with it to bypass and/or cancel a bypass of the consumer (4) in question.

5.9. The device described in number 5.8 comprising
at least one device (5) that determines
a) the current value; and/or
b) the rate of change in the current; and/or
c) a higher time derivative of the current value through the sequential circuit of the aforementioned consumers (4) of at least one or more or all of the aforementioned at least two series circuits, in particular using measurement techniques.

5.10. The device described in one or more of the preceding numbers, wherein
it has at least two consumers;
and at least one switch associated with each of them, that is a total of at least two such switches;
the controller (6) is designed to control the common energy consumption of at least these two consumers so that it corresponds, linearly or nonlinearly, with a value specified by the controller (6) or from outside the system; and
the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

5.11. The device described in number 5.10, wherein the consumers are lamps or light-emitting diodes in one or more luminous colors.

5.12. The device described in one of the preceding numbers, wherein the energy supply unit is designed to make the energy conversion dependent, both in its amount and/or in its apportionment to the consumers, on one or more of the following parameters:
a) a value that is received through an interface or programmed; and/or
b) the measured value of one or more color sensors; and/or
c) the measured value of a temperature sensor; and/or
d) the measured value of another sensor that measures an effect of at least one of the consumers.

6. A device including
at least one first consumer, at least one current source, and an energy supply unit to supply energy to the at least one first consumer (4), wherein the energy supply unit is provided with
at least one energy storage (2),
wherein energy can be fed into a first output node (7) by the at least one current source (1) and the at least one energy storage (2),
wherein the at least one first consumer (4) can at least temporarily be supplied with energy through this output node (7),
wherein the energy storage (2) is designed to supply energy when the energy delivery of the current source (1) is insufficient and the energy storage (2) still has sufficient energy content,
at least one switch (3) connected in parallel with at least one first consumer (4) to bypass and/or cancel a bypass of the first consumer (4) associated with the switch (3); and
at least one current and/or current change detection device (5) and/or an energy and/or energy change detection device,
wherein the current and/or current change detection device (5) is designed to determine
a) the current value; and/or
b) the rate of change in the current; and/or
c) a higher time derivative of the current value through the aforementioned first consumer (4) or a sequential circuit of multiple first consumers (4);
in particular using measurement techniques; and
wherein the energy and/or energy change detection device (14) is designed to determine
a) the remaining energy content in the at least one energy storage (2); and/or
b) the rate of change of the energy content in the at least one energy storage (2); and/or
c) a higher time derivative of the energy content in the at least one energy storage (2);

in particular using measurement techniques, wherein the energy content can also be determined by determining a variable representing it; and at least one controller (6) that opens or closes at least one of the switches (3), or changes its conducting-state DC resistance, on the basis of at least one of the previously determined values.

wherein the energy supply unit is designed not to turn on or off any second switch or change its conducting-state DC resistance during the turning on and/or off or changing the conducting-state DC resistance of at least of one first switch; and/or so that the time interval between the turning on and/or off of at least one first switch or changing of its conducting-state DC resistance and the turning on and/or off of at least one second switch or changing of its conducting-state DC resistance does not to fall below a minimum value $t_{min_s}$.

6.1. The device described in number 6, wherein it has more than one first consumer (4) and these first consumers (4) are connected in series; and the first consumers (4) can be supplied by at least a partial current of the current source (1).

6.2. The device described in number 6 or 6.1, wherein the energy supply unit is designed not to close any switch or to reduce its conducting-state DC resistance a) if the measured current value lies above a specified value $I_{max1}$; and/or b) if the amount of the measured rate of change in the current lies above a specified value $I_{max_sp1}$; and/or c) if the amount of the measured higher time derivative of the current value lies above a specified value $I_{max_ac1}$; and/or not to open any switch or to increase its conducting-state DC resistance a) if the measured current value lies below a specified value $I_{min1}$; and/or b) if the amount of the measured rate of change in the current lies below a specified value $I_{min_sp1}$; and/or c) if the amount of the measured higher time derivative of the current value lies below a specified value $I_{min_ac1}$.

6.3. The device described in one or more of the numbers 6 through 6.2, wherein the energy supply unit is designed to reduce, at least temporarily, the mean duration of the closing or the reduction in the conducting-state DC resistance of a switch relative to a time period if the measured current value lies above a specified value $I_{max2}$; and/or to reduce, at least temporarily, the mean duration of the closing or reduction in the conducting-state DC resistance of a switch relative to a time period if the amount of the measured rate of change in the current lies above a specified value $I_{max_sp2}$; and/or to reduce, at least temporarily, the mean duration of the closing or reduction in the conducting-state DC resistance of a switch relative to a time period if the amount of the measured higher time derivative of the current value lies above a specified value $I_{max_ac2}$; and/or to increase, at least temporarily, the mean duration of the closing or reduction in the conducting-state DC resistance of a switch relative to a time period if the measured current value lies below a specified value $I_{min2}$; and/or to increase, at least temporarily, the mean duration of the closing or reduction in the conducting-state DC resistance of a switch relative to a time period if the amount of the measured rate of change in the current lies below a specified value $I_{min_sp2}$; and/or to increase, at least temporarily, the mean duration of the closing or reduction in the conducting-state DC resistance of a switch relative to a time period, if the amount of the measured higher time derivative of the current value lies below a specified value $I_{min_ac2}$.

6.4. The device described in one or more of the preceding numbers, wherein the energy supply unit is designed to lower, at least temporarily, the mean duration of the closing or reduction in the conducting-state DC resistance of a switch relative to a time period if the measured energy content of the energy storage 2 lies below a specified value $U_{es_min2}$; and/or to lower, at least temporarily, the mean duration of the closing or reduction in the conducting-state DC resistance of a switch relative to a time period if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period if the measured energy content of the energy storage 2 lies above a specified value $U_{es_min3}$; and/or to increase, at least temporarily, the mean duration of the closing or reduction in the conducting-state DC resistance of a switch relative to a time period if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

6.5. The device described in one or more of the preceding numbers, wherein the at least one switch is a power transistor.

6.6. The device described in number 6.5 wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

6.7. The device described in number 6.5 or 6.6, wherein the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

6.8. The device described in one or more of the preceding numbers, wherein the energy supply unit is designed to close or reduce the conducting-state DC resistance of at least one first switch simultaneously with the opening or increasing of the conducting-state DC resistance of at least one second switch in order to keep the following within specified or programmed range:

a) the current value captured by a sensing element; and/or b) the rate of change in the current captured by a sensing element; and/or c) a higher time derivative of the rate of change in the current captured by a sensing element.

6.9. The device described in one or more of the preceding numbers comprising a device to supply a circuit of at least three consumers (4)

wherein these at least three consumers are connected in at least two parallel series circuits, wherein at least one of these at least two series circuits is a series circuit of at least two consumers (4); and the other series circuit of the at least two series circuits can be a single third consumer (4) or a series circuit of two or more consumers (4), wherein energy can be fed into a first output node (7) by at least one current source (1) and an energy storage (2), wherein the at least three consumers (4) can at least temporarily be supplied with energy through this output node (7), and wherein at least one of the aforementioned at least three consumers (4) has least one switch (3) connected in parallel with it to bypass and/or cancel a bypass of the consumer (4) in question.

6.10. The device described in number 6.9 comprising at least one device (5) that determines a) the current value; and/or b) the rate of change in the current; and/or c) a higher time derivative of the current value through the sequential circuit of the aforementioned consumers (4) of at least one or more or all of the aforementioned at least two series circuits, in particular using measurement techniques.

6.11. The device described in one or more of the preceding numbers, wherein it has at least two consumers;

and at least one switch associated with each of them, that is a total of at least two such switches;

the controller (6) is designed to control the common energy consumption of at least these two consumers so that it corresponds, linearly or nonlinearly, with a value specified by the controller (6) or from outside the system; and the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

6.12. The device described in number 6.11, wherein the consumers are lamps or light-emitting diodes in one or more luminous colors.

6.13. The device described in one of the preceding numbers, wherein the energy supply unit is designed to make the energy conversion dependent, both in its amount and/or in its apportionment to the consumers, on one or more of the following parameters:

a) a value that is received through an interface or programmed; and/or b) the measured value of one or more color sensors; and/or c) the measured value of a temperature sensor; and/or d) the measured value of another sensor that measures an effect of at least one of the consumers.

7. A device including at least one first consumer, at least one current source, and an energy supply unit to supply energy to the at least one first consumer (4), wherein the energy supply unit is provided with at least one energy storage (2), wherein energy can be fed into a first output node (7) by the at least one current source (1) and the at least one energy storage (2), wherein the at least one first consumer (4) can at least temporarily be supplied with energy through this output node (7), wherein the energy storage (2) is designed to supply energy when the energy delivery of the current source (1) is insufficient and the energy storage (2) still has sufficient energy content, at least one switch (3) connected in parallel with at least one first consumer (4) to bypass and/or cancel a bypass of the first consumer (4) associated with the switch (3); and at least one current change detection device (5) and/or an energy and/or energy change detection device, wherein the current change detection device (5) is designed to determine a) the rate of change in the current; and/or b) a higher time derivative of the current value through the aforementioned first consumer (4) or a sequential circuit of multiple first consumers (4), in particular using measurement techniques; and wherein the energy and/or energy change detection device (14) is designed to determine a) the remaining energy content in the at least one energy storage (2); and/or b) the rate of change of the energy content in the at least one energy storage (2); and/or c) a higher time derivative of the energy content in the at least one energy storage (2)

in particular using measurement techniques, wherein the energy content can also be determined by determining a variable representing it; and at least one controller (6) that opens or closes at least one of the switches (3), or changes its conducting-state DC resistance, on the basis of at least one of the previously determined values.

7.1. The device described in number 7 comprising at least one current detection device (5) that is designed to determine the current value through the aforementioned first consumer (4) or a sequential circuit of multiple first consumers (4).

7.2. The device described in number 7 or 7.1, wherein it has more than one first consumer (4) and these first consumers (4) are connected in series; and the first consumers (4) can be supplied by at least a partial current of the current source (1).

7.3. The device described in number 7.1 or 7.2, wherein the energy supply unit is designed not to close any switch or to reduce its conducting-state DC resistance a) if the measured current value lies above a specified value $I_{max1}$; and/or b) if the amount of the measured rate of change in the current lies above a specified value $I_{max_sp1}$; and/or c) if the amount of the measured higher time derivative of the current value lies above a specified value $I_{max_ac1}$; and/or not to open any switch or to increase its conducting-state DC resistance a) if the measured current value lies below a specified value $I_{min1}$; and/or b) if the amount of the measured rate of change in the current lies below a specified value $I_{min_sp1}$; and/or c) if the amount of the measured higher time derivative of the current value lies below a specified value $I_{min_ac1}$.

7.4. The device described in one or more of the numbers 7 through 7.3, wherein the energy supply unit is designed to reduce, at least temporarily, the mean duration of the closing or the reduction in the conducting-state DC resistance of a switch relative to a time period if the measured current value lies above a specified value $I_{max2}$; and/or to reduce, at least temporarily, the mean duration of the closing or reduction in the conducting-state DC resistance of a switch relative to a time period if the amount of the measured rate of change in the current lies above a specified value $I_{max_sp2}$; and/or to reduce, at least temporarily, the mean duration of the closing or reduction in the conducting-state DC resistance of a switch relative to a time period if the amount of the measured higher time derivative of the current value lies above a specified value $I_{max_ac2}$; and/or to increase, at least temporarily, the mean duration of the closing or reduction in the conducting-state DC resistance of a switch relative to a time period if the measured current value lies below a specified value $I_{min2}$; and/or to increase, at least temporarily, the mean duration of the closing or reduction in the conducting-state DC resistance of a switch relative to a time period if the amount of the measured rate of change in the current lies below a specified value $I_{min_sp2}$; and/or to increase, at least temporarily, the mean duration of the closing or reduction in the conducting-state DC resistance of a switch relative to a time period, if the amount of the measured higher time derivative of the current value lies below a specified value $I_{min_ac2}$.

7.5. The device described in one or more of the preceding numbers, wherein the energy supply unit is designed to lower, at least temporarily, the mean duration of the closing or reduction in the conducting-state DC resistance of a switch relative to a time period if the measured energy content of the energy storage 2 lies below a specified value $U_{es_min2}$; and/or to lower, at least temporarily, the mean duration of the closing or reduction in the conducting-state DC resistance of a switch relative to a time period if the amount of the measured rate of change in the energy content of the energy storage 2 lies above a specified value $U_{es_max_sp2}$; and/or to lower, at least temporarily, the mean duration of the closing or reduction in the conducting-state DC resistance of a switch relative to a time period if the amount of the measured higher time derivative of the energy content of the energy storage lies above a specified value $U_{es_max_ac2}$; and/or to increase, at least temporarily, the mean duration of the closing or reduction in the conducting-state DC resistance of a switch relative to a time period if the measured energy content of the energy storage 2 lies above a specified value $U_{es_min3}$; and/or to increase, at least temporarily, the mean duration of the closing or reduction in the conducting-state DC resistance of a switch relative to a time period if the amount of the measured rate of change in the energy content lies below a specified value $U_{es_max_sp3}$; and/or to increase, at least temporarily, the mean duration of the closing or reduction in the conducting-state DC resistance of a switch relative to a time period, if the amount of the measured higher time derivative of the energy content of the energy storage 2 lies below a specified value $U_{es_min_ac3}$.

7.6. The device described in one or more of the preceding numbers, wherein the at least one switch is a power transistor.

7.7. The device described in number 7.6 wherein the power transistor can be controlled by a controller, so that the current value captured by a sensing element during a switching process can be used as at least one controlled variable of this controller and the power transistor is designed to limit the current value to a value smaller than 1.1 or 1.2 or 1.4 times the value that flows through the consumers without a switching process, or double this value.

7.8. The device described in number 7.6 or 7.7, wherein the power transistor can be controlled by a controller, so that the current value captured by a sensing element during a switching process can be used as at least one controlled variable of this controller and the power transistor is designed to limit the current value to a value greater than 0.9 or 0.8 or 0.5 or 0.3 times the value that flows through the consumers without a switching process.

7.9. The device described in one or more of the preceding numbers, wherein the energy supply unit is designed to close or reduce the conducting-state DC resistance of at least one first switch simultaneously with the opening or increasing of the conducting-state DC resistance of at least one second switch in order to keep the following within specified or programmed range:

a) the current value captured by a sensing element; and/or b) the rate of change in the current captured by a sensing element; and/or c) a higher time derivative of the rate of change in the current captured by a sensing element.

7.10. The device described in one or more of the preceding numbers, wherein the energy supply unit is designed not to turn on or off any second switch or change its conducting-state DC resistance during the turning on and/or off or changing the conducting-state DC resistance of at least of one first switch; and/or so that the time interval between the turning on and/or off of at least one first switch or changing of its conducting-state DC resistance and the turning on and/or off of at least one second switch or changing of its conducting-state DC resistance does not to fall below a minimum value $t_{min_s}$.

7.11. The device described in one or more of the preceding numbers comprising a device to supply a circuit of at least three consumers (4) wherein these at least three consumers are connected in at least two parallel series circuits, wherein at least one of these at least two series circuits is a series circuit of at least two consumers (4); and the other series circuit of the at least two series circuits can be a single third consumer (4) or a series circuit of two or more consumers (4), wherein energy can be fed into a first output node (7) by at least one current source (1) and an energy storage (2), wherein the at least three consumers (4) can at least temporarily be supplied with energy through this output node (7), and wherein at least one of the aforementioned at least three consumers (4) has least one switch (3) connected in parallel with it to bypass and/or cancel a bypass of the consumer (4) in question.

7.12. The device described in number 7.11 comprising at least one device (5) that determines a) the current value; and/or b) the rate of change in the current; and/or c) a higher time derivative of the current value through the sequential circuit of the aforementioned consumers (4) of at least one or more or all of the aforementioned at least two series circuits, in particular using measurement techniques.

7.13. The device described in one or more of the preceding numbers, wherein it has at least two consumers;

and at least one switch associated with each of them, that is a total of at least two such switches;

the controller (6) is designed to control the common energy consumption of at least these two consumers so that it corresponds, linearly or nonlinearly, with a value specified by the controller (6) or from outside the system; and the controller (6) is designed to control the relative energy consumption of at least these two consumers, each individually, so that keeping the aforementioned common energy consumption within the permissible tolerances of the application in which the device is being operated does not depend on the individual relative energy consumptions of at least these two consumers.

7.14. The device described in number 7.13, wherein the consumers are lamps or light-emitting diodes in one or more luminous colors.

7.15. The device described in one of the preceding numbers, wherein the energy supply unit is designed to make the energy conversion dependent, both in its amount and/or in its apportionment to the consumers, on one or more of the following parameters:

a) a value that is received through an interface or programmed; and/or b) the measured value of one or more color sensors; and/or c) the measured value of a temperature sensor; and/or d) the measured value of another sensor that measures an effect of at least one of the consumers.

SUMMARY OF THE DRAWINGS

Examples of the device are explained in more detail with reference to the following figures.

DESCRIPTION

Figure 1:
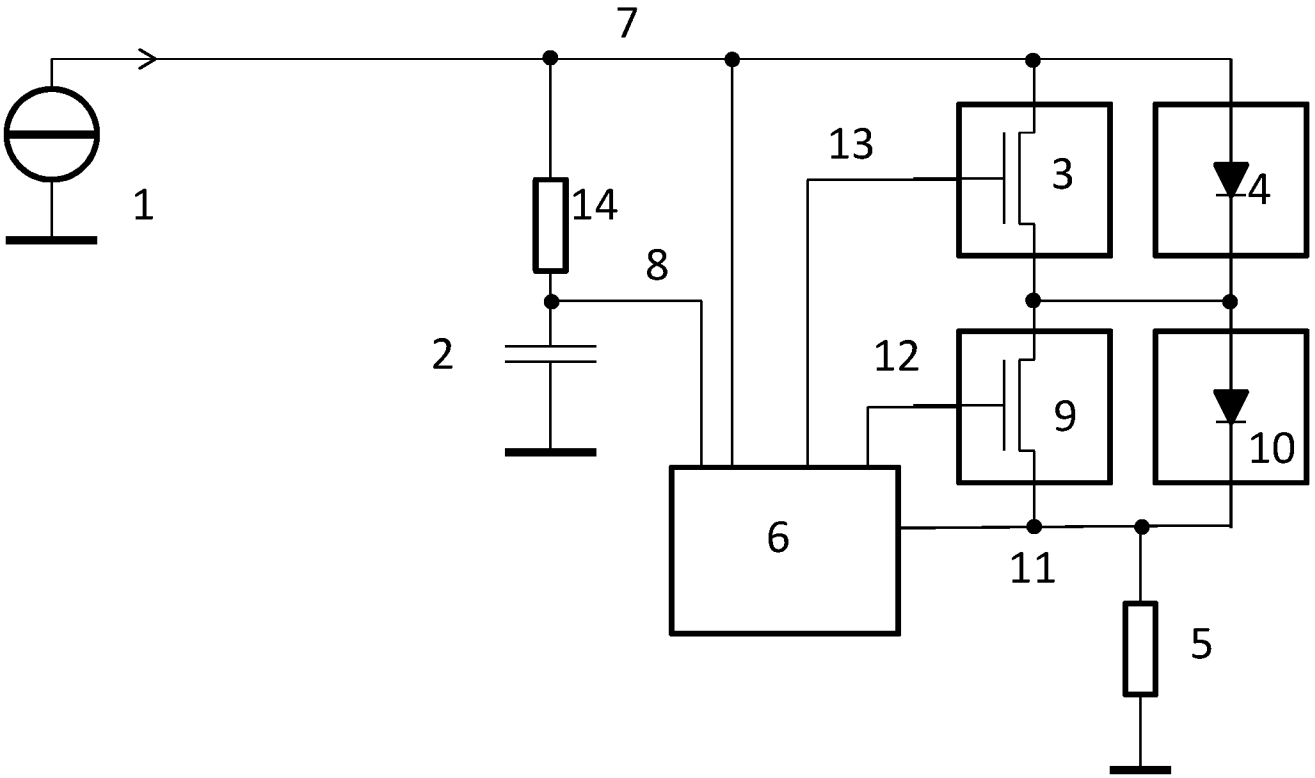
FIG. 1 a block diagram of an example device.

The goal is achieved by evaluating the current in the loads 4 at the switching elements 3 during the switching process by a current measuring element 5 or by a controller 6.

The purpose of controller 6 is to evaluate either the voltage or the rate of change in the voltage dU/dt at energy storage 2 or the change in current at measuring element 5 or at both components, in order to specify, check, and thus ensure the operation within a predefined operating state space.

The described failures during OPENING and CLOSING (see above) can thus be prevented. Thus, it is possible to prevent an uncontrolled excessive increase or reduction of the current during the transient transitions in the system, or at least limit their effect in a controlled manner.

Especially in the case of LEDs as consumers, this can clearly increase the life of the diodes by controlling peak currents through the described device to damp and control them.

Another advantage of the described device and the described process is the possibility of adaptive control, which under given constraints, such as, e.g., the aging of components, e.g., the age-related change in the capacitance 2, which allows the shortest possible transient reversal of the switching elements 3.

The current source 1 in FIG. 1 supplies the current and the energy for the consumers 4, 10, which are connected in series. In this case, the consumers are, for example, a first light-emitting diode 4 and a second light-emitting diode 10. Light-emitting diodes will be referred to below as LEDs.

In this case, the energy storage 2 is a capacitor 2 that buffers the voltage at the output node 7 of the current source 1. In this example, this is done through an optional series resistor 14 between the output node 7 of the current source 1 and the connection node 8 of the capacitor 2, which acts as an energy storage 2. In this example, the other terminal of the capacitor 2 is grounded. This sample arrangement advantageously allows the evaluation of the amount of energy or the change in the amount of energy in the storage 2.

As has already been described, the first LED 4 and the second LED 10 each have a first switch 3 and a second switch 9 correspondingly associated with them which, by CLOSING or OPENING bypass the LEDs 4, 10, and can, in this way, change the energy distribution within the LED chain made of these LEDs 4, 10. Thus, to accomplish the goal, it is not the energy source, that is the current source 1, that is controlled, but rather all the consumers 4, 10.

To make the OPENING and CLOSING of the switches 3, 9 such that the tolerances for the current through the consumer chain, that is through the LED chain consisting of the LEDs 4, 10, are not exceeded, it is possible to measure, for example through a shunt resistor 5, the current through the aforementioned consumer chain by capturing the voltage drop between the current capture node 11 and ground. Instead of a shunt resistor 5, of course other current measurement methods are also conceivable, such as, for example, a Hall effect sensor or an AMR sensor. It is also possible, for example, to use the resistor 14 at the energy storage 2 for evaluation, since the sum of the current going into the energy storage 2 or coming out of it and the current through the consumer chain 4, 10 and the switches 3, 9 must be equal to the current source current.

The signal 11 captured in this way is fed to the controller 6, which typically also monitors the energy content of the energy storage 2, for example, by measuring the potential of the node 8 of a capacitor 2. Moreover, it is also useful to monitor the voltage of the input node 7, which allows measurement of the current going into the energy storage and coming out of it by means of the already mentioned shunt resistor 14.

This allows the energy content of the capacitor or of the energy storage 2 to be closed. It is also possible to use the time derivatives of the variables to determine the rates of change in the energy content.

Thus, when the measurement of the energy content is being discussed, then only one method is meant with which the energy content can be sufficiently inferred, at least for the application. Of course other measuring points are also conceivable.

Figure 2:
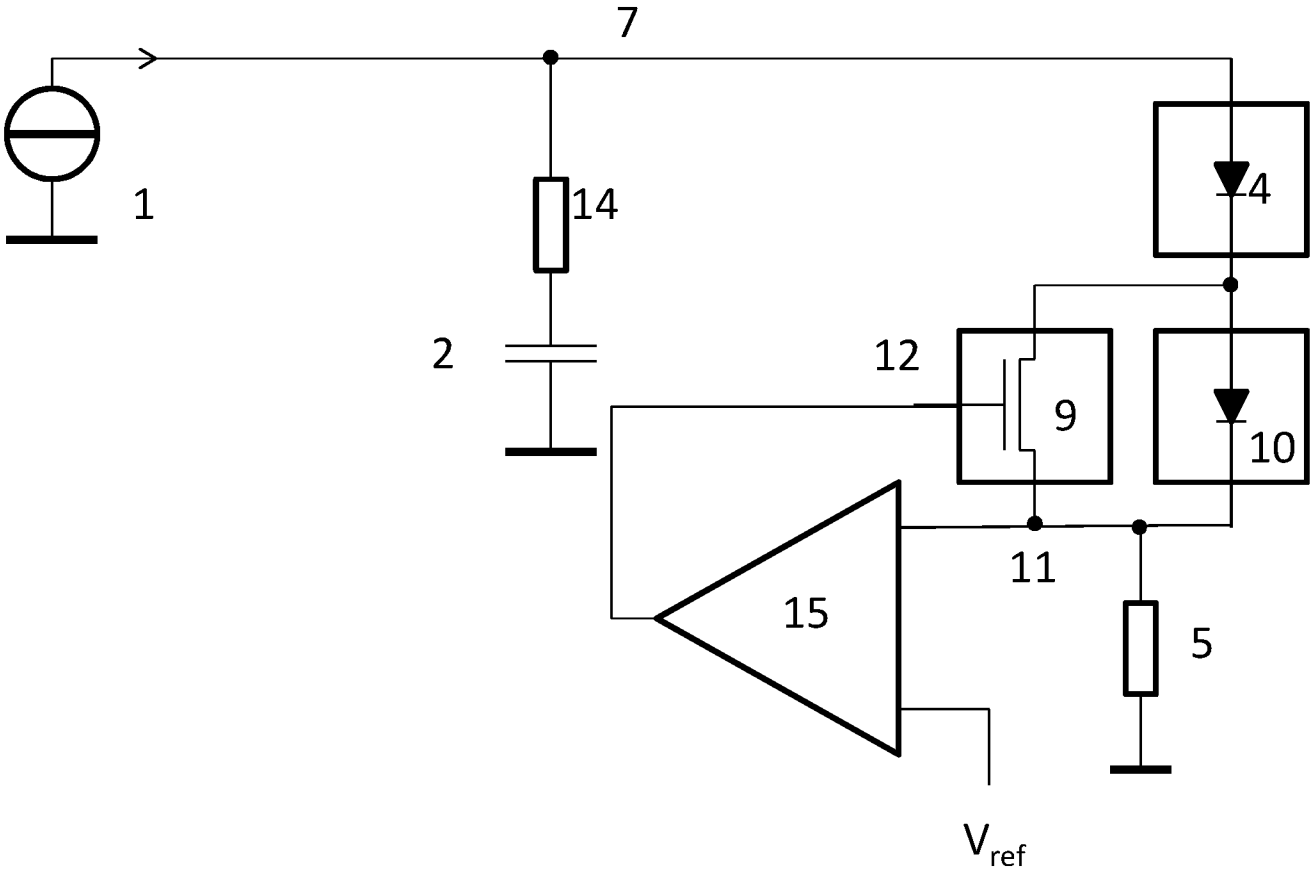
FIG. 2 an example of a controller for a switch.

FIG. 2 shows an implementation of a system in which only one consumer 10 is controlled in a chain of two useful consumers 4, 10.

The especially simple technical implementation of a very simple variant of the controller 6, which does not have all possible features of this controller, but can already belong to an device, is in this case a transimpedance amplifier 15, which adapts the controlling currents at a switching element 9 using the Miller effect for control. Of course the disclosure also includes considerably more complicated variants of the controller 6, which follow from the basic ideas of the disclosure for the person skilled in the art. Some possible further developments of such a controller are described below. Here the controller 6 now compares the voltage drop across the sample shunt resistor 5 at node 11 with a sample reference voltage $V_{ref}$, which functions as a specifiable setpoint reference.

Corresponding filters can make the controller a P, PI, PID, or PD controller, for example, among other things. Of course more complex control transfer functions of the controller 6 with multidimensional, i.e., multiparametric input and output signals are conceivable, and are useful especially in more complicated topologies, as described below.

Thus, the device serves to supply a circuit with at least one consumer. It has at least one current source 1. The supply of energy is stabilized through at least one energy storage 2 in the form, e.g., of a capacitor, accumulator, etc. This energy storage 2 can also be a coil, which is inserted in the electric circuit in serial, for example. Both current source 1 and energy storage 2 feed energy into a first output node 7. The aforementioned consumers 4 are at least temporarily supplied with energy through this output node 7. This is because it is also conceivable that the system is not always active. The energy storage 2 always supplies energy when the energy delivery of the current source 1 is insufficient to supply the consumers 4, 10 and the energy storage 2 still has sufficient energy content. This sufficient energy content is constantly measured and predicted by the controller 6 and suitable measuring points 8, 7 in the system. If the energy removal by the loads 4, 10 from the combined energy source of the current source 1 and the energy storage 2 is too high or too low, then a change is made in the total load 4, 10, which is a control variable for correcting this situation. Therefore, in the case of two consumers, at least one of the aforementioned two consumers 4 has at least one switch 9 connected in parallel with it. Thus, this switch can bypass at least one of the consumers 10 to lower, if necessary, the internal resistance of the total load of the consumers 4, 10, or to cancel such a bypass, to raise the internal resistance of the total load of the consumers 4, 10. For the purpose of this control, it is useful for there to be sensors to measure the state of the total load 5, the energy storage 14, and the energy conversion in the total load. Therefore, the device has a measuring device 5 that is able to measure the current value to capture the electric current flowing through the total load 4, 10 and thus, as a rule, also the rate of change in the current or a higher time derivative of the current through the sequential circuit of the aforementioned consumers 4, 10. The measurement the derivatives allows a prognosis of the current's development, and thus timely control of the load 4, 10 to counteract it. In the same way, it is useful to capture the remaining energy content of the energy storage 2 by means of at least one other measuring device 14. Here again it is also useful to capture the rate of change in this energy content of the energy storage 2, or a higher time derivative this energy content of the aforementioned energy storage 2, and perform an anticipatory control. Here the energy conversion in the total load of the consumers 4, 10 can be calculated from the voltage drop between the nodes 7 and 11 and that between the nodes 11 and ground. The control by the controller 6 involves, as already described, opening or closing at least one of the switches 3, 9, or changing its conducting-state DC resistance, as a function of at least one of the previously determined values so that the current does not exceed or fall below its tolerance values.

Here it should be noted that with power transistors although completely CLOSING or OPENING is useful, it can lead to the aforementioned current spikes. Therefore, it is especially favorable, with the described transimpedance amplifier 15, to actuate or close the power transistors 3, 9 slowly enough that there are no current spikes, or defined, specified ones. This will significantly prolong the life of the LEDs 4, 10. Thus, when OPENING or CLOSING is being discussed, this means a controlled OPENING and CLOSING, in which the current does not exceed or fall below the specified tolerances.

In the context of the disclosure it was recognized that it is useful if no other switch 3, 9 is closed or has its conducting-state DC resistance increased if the measured current through all the consumers 4, 10 lies above a specified value $I_{max1}$, since this would aggravate the situation. The same goes if the amount of the measured rate of increase in the current lies above a specified value $I_{max_sp1}$ or if the amount of the measured higher time derivative of the current lies above a specified value $I_{max_ac1}$.

In the same way, it is not useful for one of the switches 3, 9 to be opened or have its conducting-state DC resistance increased if the measured current through all the consumers 4, 10 lies below a specified value $I_{min1}$. The case when the amount of the measured rate of increase in the current lies below a specified value $I_{min_sp1}$ or when the amount of the measured higher time derivative of the current lies below a specified value $I_{min_ac1}$ is analogous.

Of course it is conceivable, assuming general current-driven loads, to carry out PWM modulation instead of the analogous adjustment of the conducting-state DC resistances of the switches 3, 9. This involves, for example, reducing, at least temporarily, the mean duration of the closing or the reduction in the conducting-state DC resistance of one of the switches 3, 9 relative to a time period if the measured current through all the consumers 4, 10 lies above a specified value $I_{max2}$. Analogously, the mean duration of the closing or reduction in conducting-state DC resistance of one of the switches 3, 9 is lowered relative to a time period, if the amount of the measured rate of increase in the current lies above a specified value $I_{max_sp2}$, or if the amount of the measured higher time derivative of the current lies above a specified value $I_{max_ac2}$. Conversely, the mean duration of the closing or reduction in conducting-state DC resistance of one of the switches 3, 9 is at least temporarily increased relative to a time period, if the measured current lies below a specified value $I_{min2}$, if the amount of the measured rate of increase in the current lies below a specified value $I_{min_sp2}$, or if the amount of the measured higher time derivative of the current lies below a specified value $I_{min_ac2}$.

In the same way, the mean duration of the closing or reduction in conducting-state DC resistance of one of the switches 3, 9 is at least temporarily lowered relative to a time period, if the measured energy content of the energy storage 2 lies below a specified value $W_{es_min2}$, or if the amount of the measured rate of change in the energy content of the energy storage 2 lies above a specified value $W_{es_max_sp2}$, or if the amount of the measured higher time derivative of the energy content of the energy storage lies above a specified value $W_{es_max_ac2}$. Since the voltage at the node 8 is a good measure of the energy content, it is possible, when a capacitor is used as energy storage 2, to compare these capacitor voltages with the corresponding voltage limits $U_{es_min2}$, $U_{es_max_sp2}$, $U_{es_max_ac2}$ as a measure instead, when deciding whether to introduce these measures. Thus, when the claims mention energy content and the comparison of the energy content and/or its time derivatives with a value, this means not only energy content and its derivatives, but rather also all physical variables that allow an equivalent statement, and their corresponding analogous limits. Conversely, the mean duration of the closing or reduction in conducting-state DC resistance of one of the switches 3, 9 is analogously at least temporarily increased relative to a time period, if the measured energy content of the energy storage 2 lies above a specified value $U_{es_min3}$, or the amount of the measured rate of change in the energy content lies below a specified value $U_{es_max_sp3}$, or the mean duration of the closing or reduction in the conducting-state DC resistance of one of the switches 3, 9 relative to a time period is at least temporarily increased, if the amount of the measured higher time derivative of the energy content of the energy storage 2 lies below a specified value $U_{es_min_ac3}$.

As has already been described, the switches 3, 9, which are typically power transistors, are controlled by a regulating element, a controller 6. This is done by having the measuring element 5 capture the current that flows through all the loads 4, 10 during a switching process, and using this current value as a controlled variable of this regulating element 6. The control is performed by a power transistor 3, 9, which then limits the current, for example, to a value smaller than 1.1 or 1.2 or 1.4 times the value that flows through the consumers without a switching process, or double this value. This is the same as saying that this limits the current overshoot to 10% or 20% or 40% or 100%.

Conversely, the regulating element 6 limits an undershoot, for example, to 10%, 20%, 50%, or 70% of this value, by suitably controlling the power transistor 3, 9. Here also, the current that flows through all the consumers 4, 10 is captured by the measuring element 5 during a switching process, and is used as a controlled variable of this regulating element 6. In this case, power transistors 3, 9 limit the current to a value to a value greater than 0.9 or 0.8 or 0.5 or 0.3 times, in turn, the value that flows through the consumers 4, 10 without a switching process.

Figure 3:
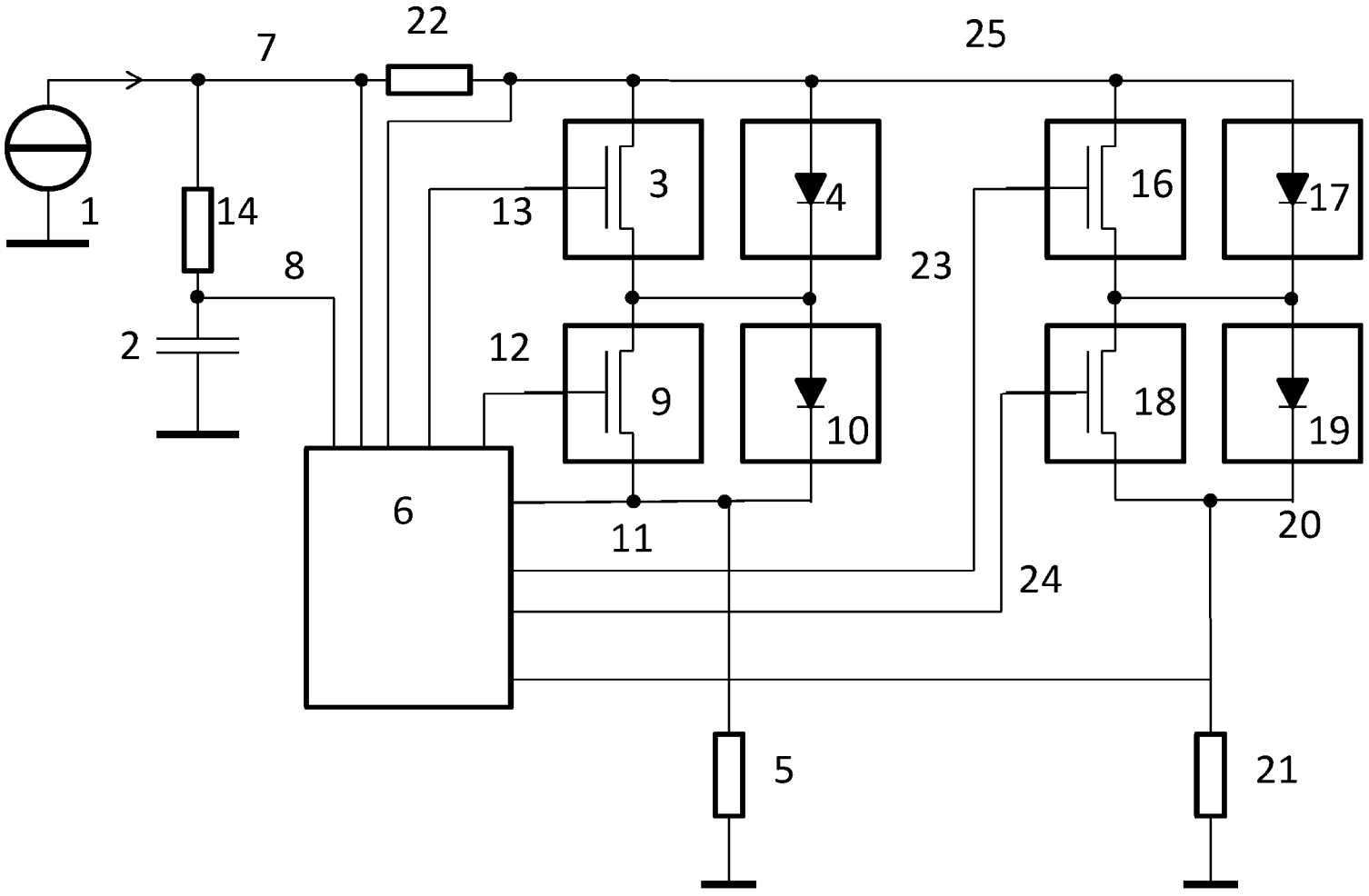
FIG. 3 an example of a device with two parallel strings.

The example shown in FIG. 3 is described below.

Now it is also conceivable for multiple series strings of consumers, for example a first string of consumers of two consumers 4, 10 connected in series and a second string of consumers of two other consumers 17, 19 connected in series to be supplied in parallel by one current source 1. This arrangement can advantageously be used to distribute the load between the two strings of consumers.

Here it can be useful, for example, first that a current measurement point 22 is provided for the total current going into both strings of consumers, and second that every string of consumers has its own current measurement device 5, 21.

The switches 3, 9, 16, 18 are controlled by the controller 6 through the control lines 12, 13, 23, 24. This example uses shunt resistors 14, 22, 5, 21 as sample current measurement points. The corresponding potentials of the associated nodes 7, 8, 20, 11, 25 are sample input signals that are fed to the controller 6, which uses them to produce the control signals 12, 13, 23, 24 for the switches 3, 9, 16, 18.

In this case, and in the case in which all consumers 4, 10, 17, 19 are supposed to be supplied with energy at least temporarily within a period, it is useful to carry out the bypass of the consumers 4, 10, 17, 19 in alternation. For example, it can be necessary to turn on multiple consumers 4, 10, 17, 19, for example LEDs, at least temporarily. Here it can be necessary for the time of the addition of energy within a time period to be proportionally divided, it being possible, but not necessary, for the activity intervals of multiple consumers to overlap. In the same way, there can be times when no consumer 4, 10, 17, 19 is consuming energy and the energy storage 2 is or can be charged with energy, if necessary. In the case of a capacitor 2, these are charging and discharging processes. If this should occur, then it must be possible for all consumers to be separated. Such a switch, which would be in serial with all consumers, is not shown in the figures.

During such a process of switching from one load to another it is useful that CLOSING or a reducing the conducting-state DC resistance of a first switch, for example switch 3 simultaneously with the OPENING or increase in the conducting-state DC resistance of a second switch, for example switch 16, keeps the current in the measuring element 22 or the rate of change of the current in the measuring element 22 or a higher time derivative of the rate of change of the current in the measuring element 22 within the specified or programmed range.

In the case when multiple branches of series consumers are connected in parallel, the measuring element 22 can also consist of multiple such elements 5, 21 in the individual branches with subsequent summation or specification of a vector range, or of one measuring element 22 at neutral points.

Therefore, it is possible that these conditions apply to the total current of a series sub-branch and/or for the total current of multiple series sub-branches and/or for the total current of all consumers supplied by the current source. It is also conceivable to specify conditions both for multiple sub-branches and/or for the total current.

In the case of at least two parallel loads to be supplied from one source 1, a specified current distribution in these loads can be advantageously produced by having the controller 6 modulate the switching elements 3. This modulation of the switching elements 3 by the controller 6 can be done, for example using analog impedance variations or in a time-discrete manner using PWM control. The reason why this is of special interest is that otherwise the current distribution to the at least two branches can change in an uncontrolled manner.

Analogously, it is possible to limit the number of switching processes in the consumer network that may overlap. Thus, while a first switch, for example switch 4, is being turned on and/or off, that is while it is being OPENED or CLOSED, or while its conducting-state DC resistance is being changed, it is useful that no second switch, or only a specified number of second switches, be turned on or off or have its/their conducting-state DC resistance change. An advantageous design of this overlapping is to OPEN and CLOSE two times N switches 3 at the same time so that the specified setpoint variable remains constant during the transitions.

Moreover, it is useful if it is ensured that such events be spaced apart so that the electromagnetic interference spectrum emitted by the device meets the respective requirements of the application. For example, it is conceivable to specify a minimum time interval, designated here as $t_{min_s}$, between two switching processes.

Thus, a device can typically also have multiple branches of series circuits of consumers connected in parallel, each of which in turn, when considered by itself, representing a device. Of course it is possible for one branch not to be a device, if its influence can be compensated by the control capabilities of the branch. Thus, in the simplest case it can be an single consumer, which is connected in parallel with a series circuit of two consumers or even only one single consumer, and which possibly also has a switch. Such a consumer network can have, at various places, other energy storages and current sources that stabilize and limit the current in individual branches, if necessary.

In such a network, at least one consumer must have a switch connected in parallel in order for the control to be able to act. Of course, in the same way it can be useful to monitor each of the branches individually or the total of multiple branches by separate measuring devices. Here also it is possible to measure each current value itself, or the rate of change in the current, or a higher time derivative of the current through the respective affected sequential subtree of the aforementioned consumers.

Finally, it should also be mentioned that the controller 6 can cancel the process of opening and closing a switch, for example switch 3, if the system response in the form of the change over time of one of the currents at one or more of the measurement points 14, 22, 5, 21 is not within a tolerance band around an expected current change vs. time function. The example has four currents at the measurement points 14, 5, 22, 21, that is a current vector. Accordingly, the tolerance band can also be a tolerance band with a multidimensional cross section. That is, in this case, for example, a four-dimensional cross section.

This opens the possibility of inferring an error. This is especially advantageous for detecting safety-relevant failures, for example, in the tail lights of motor vehicles. That is, for example, if the current should now collapse when switch 3 is OPENED, it is possible that there is a fault in the corresponding load 4, for example an LED, such that the electric circuit in this load 4 is interrupted due to a fault in this load 4.

Conversely, it is possible to detect a short circuit in load 4 if the current does not rise, but rather stays the same, for example, when switch 3 is CLOSED.

Thus, the device can infer the state of the consumer chain, consisting in this example of the consumers 4, 10, 17, 19, and in particular whether it is functioning correctly.

The controller 6 can then, depending on the requirement, first change the controller function or even completely cancel the opening or closing process and/or OPEN or CLOSE other switches or change their state or the topology of the device in some other way.

This monitoring has relevance in buck switching regulators, which in the case of small input voltage would output a maximum of exactly this same voltage. This is often the case in vehicles, for example. For example, motor vehicles typically have a voltage dip during the starting or start/stop process.

Figure 4:
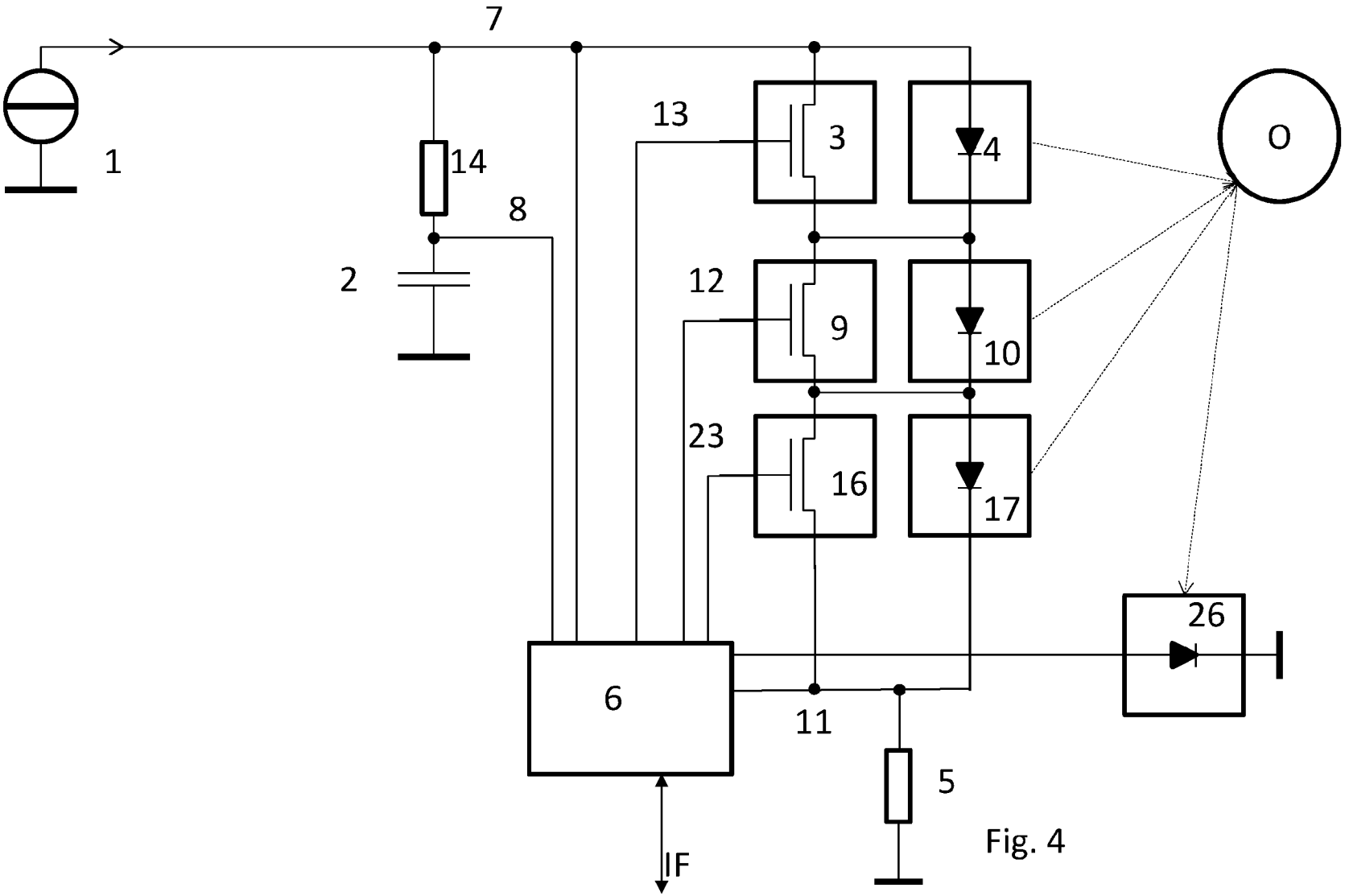
FIG. 4 an example of a device to drive a color controllable RGB illumination.

Finally concerning FIG. 4 it should also be mentioned that in the case of a series circuit of multiple consumers 4, 10, 17, the energy absorption of the individual consumers 4, 10, 17 can be regulated, both as a total and relative to one another. As an example, the control of an RGB light-emitting diode unit for color illumination of an object O should be described here.

For example, in the case of three consumers 4, 10, 17 in series, each with one switch 3, 9, 16, it is conceivable to make the OPENING and CLOSING of the switches 3, 9, 16 dependent on three parameters, hereafter described as Y, M, K.

The activity of the consumers 4, 10, 17 is modulated using PWM modulation, for example. If the three consumers 4, 10, 17 are, for example, three LEDs in the three primary colors red, yellow, and blue, then the Y signal regulates the brightness of all three diodes, and M and K regulate the color vector, that is the relative brightness of the three diodes to one another. Since human perception is strongly nonlinear, it is useful for the color vector to be corrected, if necessary, by a correction function of the controller 6 that depends on the Y signal and other brightness-determining parameters.

In the meaning used here, a brightness-determining parameter would be, for example, the energy delivery of the current source and the energy content of the energy storage 2, and their derivatives.

Of course the use of any color space model other than a YMK color space is conceivable. Examples of this would be the following:

- the LMS color space—the physiological color space that is built on the spectral sensitivities of the L, M, and S cones;
- the XYZ color space—a standard color space originally set up by the International Commission on Illumination (CIE) that is constructed on the mathematical coordinates X, Y, Z, which are created from cone sensitivities;
- the RGB color space—the color space used for computer monitors and as an Internet standard;
- the CMYK color model—the model used in desktop publishing and in the final stage of the printing process;
- the HSV color space with the variants HSL, HSB, HSI—designs that are typically used for documentation of painting and in video art;
- the LAB color space—a CIE color space derived from XYZ that also comprises all perceivable colors; the DIN99 color space is a further development of it;
- the LCh color space, which does not designate another color space in the true sense of the word, but rather is a representation of HSV, LUV, or LAB in polar coordinates;
- the I1I2I3 color space, which is a computationally optimized color space for image processing;
- the YCbCr color model (called YCC for short), which is used in digital television especially in digital PAL, as well as in digital NTSC, DVB, JPEG, MPEG, and DVD video;
- the xvYCC color space, an extended-gamut YCbCr color space that uses the full 8 bits per color channel and is used for flat screens;
- the YPbPr color model, that was used for analog HDTV and analog component video signals;
- the YUV color model, which was used for analog PAL and NTSC;
- the YIQ color model, which was used in older forms of analog NTSC;
- the YDbDr color model, which was used in analog SECAM; and the YCC color model, which is used for special photo CDs.

These formats, which are provided as examples are non-limiting, and only represent a portion the possible color formats.

It is useful for a color sensor 26 to measure either:

1. the emission of the light-emitting diodes; and/or
2. the reflection off the object to be illuminated, and if these values are passed to the controller 6.

This is an example of the general case in which the effect of the consumers 4, 10, 17 is monitored and also tracked by the controller 6.

The controller 6 now sees to it that 1. the brightness of the illumination, and thus the energy consumption of the loads 4, 10, 17 that corresponds to the amount of energy made available by the current source 1 and the energy storage 2; and
2. the apportionment of the amount of energy to the consumers 4, 10, 17 corresponds to the goal—here a specified color illumination or color reflection by an illuminated object O.

Incidentally, FIG. 4 also shows only the control of the color reflection off object O.

It is especially advantageous that the process can detect faulty states of the consumers 4, 10, 17, as described above.

Therefore it is useful if the controller can exchange state data with a control device, for example a data processing system, through an interface IF.

This state data can be, for example, fault states, switch states of the switch signals 13, 12, 23, and thus control values, values of the sensors 26 and the current measurement points 14, 5, and voltages at the nodes 7, 11, among other things.

Another control parameter can be the temperature of the system or parts of the system, in particular the temperature of the consumers 4, 10, 17 or the switches 13, 12, 23 or the current source 1. Although FIG. 4 does not show a corresponding sensor, it is also evaluated by controller 6.

A typical control algorithm of the controller 6 is then selected so that the energy removal from the two energy sources, the current source 1 and the energy storage 2, always corresponds to a maximum value or an internally or externally specified value or the current value of a specified external control function of time, if the energy removal is not limited by other factors, for example in this example the brightness specification or the temperature of system components. For example, it is conceivable that a constant value is set or, in the case of LEDs as loads, that different levels of brightness are set at certain times of the night.

This produces a process to check such a device in which one or more loads in a device are operated, as was previously described. This device has a measuring device 5 that is able to measure the current value; and/or the rate of change in the current; and/or a higher time derivative of the current value through at least a first consumer or a sequential circuit of multiple first consumers or a subnet of first consumers 4. The device also has a controller 6 that opens or closes one of the switches 3, or changes its conducting-state DC resistance, on the basis of at least one of the previously determined values. Of course devices with multiple switches and consumers are conceivable, as previously described. The aforementioned controller 6 checks, typically simultaneously, whether the time change of the current value; and/or of the rate of change in the current; and/or of a higher time derivative of the current value through the aforementioned consumer or a sequential circuit of multiple first consumers 4 or a subnet is within specification. This checking with respect to a specification involves checking whether the value to be checked agrees, within a specified tolerance band, with a specified setpoint function depending on the timing of the OPENING or CLOSING or the change in the conducting-state DC resistance.

From this, the controller 6 or another component, for example a μ controller, which receives data from controller 6 through an interface IF, determines a measurement for the state of the consumer. The control function of the controller 6 is changed on the basis of the deviation from such a setpoint function. The measurement determined in this way can also be a binary measurement. For example, it is conceivable that the measurement means "faulty" or "not faulty".

Of course an energy storage 2 in such a device can be operated in such a way that this device has a measuring device that is able to measure the following the remaining energy content of at least the energy storage 2; and/or the rate of change in the energy content of at least of the energy storage 2; and/or a higher time derivative of the energy content of at least the aforementioned energy storage 2.

The device typically has a controller 6 that typically opens or closes one of the switches 3, or changes its conducting-state DC resistance, on the basis of at least one of the previously determined values. The aforementioned controller 6 simultaneously checks whether the time change of the following:

the remaining energy content of the energy storage 2; and/or the rate of change in the energy content of at least the energy storage 2; and/or a higher time derivative of the energy content of at least the aforementioned energy storage 2 agrees with a specified function. This specified function is typically dependent on the timing of the OPENING or CLOSING or the change in the conducting-state DC resistance. The measured value may not leave a specified tolerance band. Of course once again the energy content can also be determined in the form of a significant variable. For example, it is conceivable only to integrate the current into and out of a capacitor that serves as an energy storage and to infer the charge state from this. Analogously, it is also possible to measure the capacitor voltage. Once again, as was the case above, it is possible to derive from this a measurement for the state of the energy storage. Once again, it is also possible to change the control function of the controller 6 on the basis of the deviation of such a setpoint function. Since this information can be important for higher-order systems, it is useful to transfer these state values of the device through an interface IF to the higher-order system, for example a computer system. The following are examples of values that can be transferred:

a control value of one of the outputs of the controller;

an internal control value of the controller;

a measured value or state value of one of the sensors 26;

the current value of one of the current measurement points 14, 5;

the voltage value at one of the nodes 7, 11;

the difference between the control value and the measured value at the controller 6;

the state of one or more of the switching elements 3 involved;

a measured value corresponding to the voltage across at least one of the switching elements 3;

a measured value corresponding to the current in at least one of the switching elements 3.

The invention claimed is:

1. A device for supplying energy to at least one consumer comprising:

at least one current source;

an energy supply unit including at least one energy storage; and a first output node, the first output node receiving energy from each of the at least one current source and the at least one energy storage, wherein the device is configured to supply energy at least temporarily to the consumer through the first output node and further wherein the energy storage is configured to supply energy when the energy delivery by the current source is insufficient and the energy storage still has sufficient energy content;

at least one switch configured for connection in parallel with the consumer; and at least one of:

a first measurement circuit configured to determine an operating state of the consumer; and a second measurement circuit configured to determine an operating state of the energy storage; and at least one controller programmed, based on at least one of the operating state of the consumer and the operating state of the energy storage, to do at least one of:

close the switch;

open the switch; and change a resistance of the switch.

2. The device of claim 1, wherein:

the operating state of the consumer includes at least one of:

a) a current value through the consumer;

b) a current value through a sequential circuit of one or more consumers including the consumer;

c) a rate of change of the current value through the consumer;

d) a rate of change of the current value through the circuit of consumers including the consumer;

e) a higher time derivative of the current value through the consumer; and f) a higher time derivative of the current value through the sequential circuit of consumers including the first consumer; and the operating state of the energy storage device includes at least one of:

a) a remaining energy content in the energy storage;

b) a rate of change of the energy content in the energy storage; and c) a higher time derivative of the energy content in the energy storage.

3. The device of claim 1, wherein determining the operating state of the energy storage is based on a variable representing the operating state of the energy storage.

4. The device of claim 1, wherein the at least one consumer supplied by the device includes a first consumer and one or more second consumers, and the first consumer and one or more second consumers can be supplied by at least a partial current of the current source.

5. The device of claim 2, wherein the controller is programmed not to do either of closing the switch and reducing the resistance of the switch, upon determining that at least one of:

a) a measured current value of the current through the consumer lies above a specified maximum current value;

b) a measured rate of change in the current value through the consumer lies above a specified maximum rate of change value; and c) a measured amount of a higher time derivative of the current value through the consumer lies above a specified maximum higher time derivative of the current value through the consumer; and the controller is further programmed not to do either of opening the switch and increasing the resistance of the switch upon determining that at least one of:

a) the measured current value of the current through the consumer lies below a specified minimum current value;

b) the measured rate of change in the current value through the consumer lies below a specified minimum rate of change value; and c) the measured amount of a higher time derivative of the current value through the consumer lies below a specified minimum higher time derivative of the current value through the consumer.

6. The device of claim 2, wherein the controller is programmed to:

reduce, at least temporarily, one of a mean duration of the closing and a reduction of the resistance of the switch relative to a time period upon determining that at least one of:

a) a measured current value of the current through the first consumer lies above a specified maximum current value;

b) a measured rate of change in the current value through the first consumer lies above a specified maximum rate of change value; and c) a measured amount of a higher time derivative of the current value through the first consumer lies above a specified maximum higher time derivative of the current value through the consumer; and increase, at least temporarily, one of the mean duration of the closing and the reduction in the resistance of the switch relative to the time period upon determining that at least one of:

a) the measured current value of the current through the first consumer lies below a specified minimum current value;

b) the measured rate of change in the current value through the first consumer lies below a specified minimum rate of change value; and c) the measured amount of a higher time derivative of the current value through the first consumer lies below a specified minimum higher time derivative of the current value through the consumer.

7. The device of claim 2, wherein the controller is programmed to:

lower, one of a mean duration of the closing and a reduction of the resistance of the switch relative to a time period upon determining that at least one of:

a) a measured energy content of the energy storage lies above a specified maximum value for the energy content of the energy storage;

b) a measured rate of change in the energy content of the energy storage lies above a specified maximum value for the rate of change in the energy content of the energy storage; and c) an amount of a measured higher time derivative of the energy content of the energy storage lies above a specified maximum value of the amount of the higher time derivative of the energy content; and increase, one of the mean duration of the closing and a reduction in the resistance of a switch relative to a time period upon determining that at least one of:

a) a measured energy content of the energy storage lies below a specified minimum value for the energy content of the element storage;

b) a measured rate of change in the energy content of the energy storage lies below a specified minimum value for the rate of change in the energy content of the energy storage; and c) an amount of a measured higher time derivative of the energy content of the energy storage lies below a specified minimum value of the amount of the higher time derivative of the energy content.

8. The device of claim 1 wherein the at least one switch includes a power transistor.

9. The device of claim 8, wherein the controller is programmed to control the transistor, such that a current value captured by a sensing element during a switching process can be used as at least one controlled variable of the controller.

10. The device of claim 9, wherein the current value captured by the sensing element is limited to a value smaller than 1.4 times the value of the current through the consumer without a switching process.

11. The device of claim 9, wherein the current value captured by the sensing element is limited to a value smaller than 0.9 times the value of the current through the consumer without a switching process.

12. The device of claim 1, the controller is further programmed to do one of closing a first switch and reducing a resistance of the first switch substantially simultaneously with one of opening and increasing a resistance of a second switch such that at least one of:

a) a current value captured by a sensing element;

b) a rate of change in the current captured by the sensing element; and c) a higher time derivative of the rate of change in the current captured by a sensing element;

is maintained within a specified range.

13. The device of claim 1, wherein the controller is programmed to control a second switch such that a state transition of the second switch is temporally separated from a state transition of a first switch by at least a specified time period.

14. The device of claim 13, wherein the state transition of the first switch includes at least one of a closing of the first switch, an opening of the first switch and a changing of the resistance of the first switch and the state transition of the second switch includes at least one of a closing of the second switch, an opening of the second switch and a changing of the resistance of the second switch.

15. The device of claim 1, wherein the at least one consumers includes at least three consumers; the three consumers connected in at least two series circuits arranged in parallel, wherein a first one of the at least the two series circuit includes at least two consumers and a second of the at least two series circuit includes at least one consumer; and further wherein the at least three consumers can at least temporarily be supplied with energy through the first output node; and the switch is configured to be connected in parallel with at least one of the three consumers.

16. The device of claim 1, wherein the first measurement circuit determines at least one of:

a current value through at least one of the at least two series circuits connected in parallel;

a rate of change in the current value through at least one of the at least two series circuits connected in parallel; and a higher time derivative of the current value through at least one of the at least two series circuits connected in parallel.

17. The device of claim 1, wherein the at least one consumer includes a first consumer and a second consumer; the at least one switch includes a first switch and a second switch, the first switch configured to be connected in parallel with the first consumer and the second switch configured to be connected in parallel with the second consumer; and wherein the controller is programmed to:

control the common energy consumption of the at least two consumers such that it corresponds with a value, the value specified by one of the controller and a source external to the controller; and control a relative energy consumption of the at least two consumers, each individually, such that maintaining the common energy consumption within a specified range is independent of the individual relative energy consumption of the at least two consumers.

18. The device of claim 17, wherein the consumers are one of lamps and light emitting diodes.

19. The device of claim 1, wherein the controller is programmed to control least one of a total amount of energy provided to at least one consumer and an apportionment of energy between the at least one consumers based on at least one of:

a value that is received through an interface;

a value that is programmed;

a measured value of one or more color sensors;

a measured value of a temperature sensor; and a measured value of a sensor that measures an effect of at least one of the consumers.

* * * * *